US010872620B2

(12) United States Patent
Fan

(10) Patent No.: US 10,872,620 B2
(45) Date of Patent: Dec. 22, 2020

(54) VOICE DETECTION METHOD AND APPARATUS, AND STORAGE MEDIUM

(71) Applicant: TENCENT TECHNOLOGY (SHENZHEN) COMPANY LIMITED, Shenzhen (CN)

(72) Inventor: Haijin Fan, Shenzhen (CN)

(73) Assignee: TENCENT TECHNOLOGY (SHENZHEN) COMPANY LIMITED, Shenzhen (CN)

( * ) Notice: Subject to any disclaimer, the term of this patent is extended or adjusted under 35 U.S.C. 154(b) by 52 days.

(21) Appl. No.: 15/968,526

(22) Filed: May 1, 2018

(65) Prior Publication Data

US 2018/0247662 A1 Aug. 30, 2018

Related U.S. Application Data

(63) Continuation of application No. PCT/CN2017/074798, filed on Feb. 24, 2017.

(30) Foreign Application Priority Data

Apr. 22, 2016 (CN) ..... 2016 1 0257244

(51) Int. Cl.
*G10L 25/84* (2013.01)
*G10L 25/78* (2013.01)
(Continued)

(52) U.S. Cl.
CPC ..... *G10L 25/84* (2013.01); *G10L 21/0232* (2013.01); *G10L 25/78* (2013.01);
(Continued)

(58) Field of Classification Search
CPC ..... G10L 25/00; G10L 25/03; G10L 25/09; G10L 25/18; G10L 25/21; G10L 25/84; G10L 25/87; G10L 21/0232
See application file for complete search history.

(56) References Cited

U.S. PATENT DOCUMENTS 9,437,186 B1 * 9/2016 Liu ..... G10L 15/05
9,443,521 B1 * 9/2016 Olguin Olguin ..... G10L 17/00
(Continued)

FOREIGN PATENT DOCUMENTS

CN 101197130 6/2008
CN 101625857 1/2010
(Continued)

OTHER PUBLICATIONS

Ma, Yanna, and Akinori Nishihara. "Efficient voice activity detection algorithm using long-term spectral flatness measure." EURASIP Journal on Audio, Speech, and Music Processing 2013.1 (2013): 87. (Year: 2013).*

(Continued)

*Primary Examiner* — Paras D Shah
(74) *Attorney, Agent, or Firm* — Oblon, McClelland, Maier & Neustadt, L.L.P.

(57) ABSTRACT

Embodiments of the present disclosure provide a voice detection method. An audio signal can be divided into a plurality of audio segments. Audio characteristics can be extracted from each of the plurality of audio segments. The audio characteristics of the respective audio segment include a time domain characteristic and a frequency domain characteristic of the respective audio segment. At least one target voice segment can be detected from the plurality of audio segments according to the audio characteristics of the plurality of audio segments.

17 Claims, 8 Drawing Sheets

(51) Int. Cl.

| | |
|---|---|
| ***G10L 21/0232*** | (2013.01) |
| ***G10L 21/0216*** | (2013.01) |
| ***G10L 25/06*** | (2013.01) |
| ***G10L 25/09*** | (2013.01) |
| ***G10L 25/18*** | (2013.01) |
| ***G10L 25/21*** | (2013.01) |

(52) U.S. Cl.
CPC ..... *G10L 21/0216* (2013.01); *G10L 25/06* (2013.01); *G10L 25/09* (2013.01); *G10L 25/18* (2013.01); *G10L 25/21* (2013.01)

(56) References Cited

U.S. PATENT DOCUMENTS

2002/0116189 A1* 8/2002 Yeh ..... G10L 17/08 704/248
2002/0116196 A1* 8/2002 Tran ..... G06F 1/3203 704/270
2005/0055201 A1* 3/2005 Florencio ..... G10L 25/87 704/214
2008/0154585 A1* 6/2008 Yoshioka ..... G10L 25/87 704/213
2011/0264447 A1* 10/2011 Visser ..... G10L 25/78 704/208
2012/0035920 A1* 2/2012 Hayakawa ..... G10L 21/0208 704/226
2012/0065966 A1* 3/2012 Wang ..... G10L 25/78 704/210
2012/0230483 A1* 9/2012 Bouzid ..... G10L 25/51 379/201.02
2014/0180686 A1* 6/2014 Schuck ..... G10L 15/265 704/235
2014/0278391 A1* 9/2014 Braho ..... G10L 25/78 704/233
2015/0081287 A1* 3/2015 Elfenbein ..... G10L 21/0208 704/226
2015/0228303 A1* 8/2015 Wu ..... G11B 20/10046 360/65
2015/0255090 A1* 9/2015 Kim ..... G10L 25/84 704/233
2015/0279373 A1 10/2015 Hanazawa et al.
2015/0332667 A1* 11/2015 Mason ..... G10L 15/02 704/249
2015/0371665 A1* 12/2015 Naik ..... G10L 25/87 704/248
2016/0203833 A1* 7/2016 Zhu ..... G10L 25/78 704/233
2017/0004840 A1* 1/2017 Jiang ..... G10L 25/18
2017/0084292 A1* 3/2017 Yoo ..... G10L 25/84
2017/0206916 A1* 7/2017 Zhu ..... G10L 25/78

FOREIGN PATENT DOCUMENTS

| | | |
|---|---|---|
| CN | 101685446 | 3/2010 |
| CN | 102044242 | 1/2012 |
| CN | 103117067 | 5/2013 |
| CN | 104021789 | 9/2014 |
| CN | 103077728 | 8/2015 |
| CN | 103813251 | 1/2017 |
| CN | 104464722 | 5/2018 |
| EP | 2 434 481 | 3/2002 |
| JP | 62-150299 | 7/1987 |
| JP | 4-223497 | 8/1992 |
| JP | 5-165499 | 7/1993 |
| JP | 2002-258881 | 9/2002 |
| JP | 2004-272052 | 9/2004 |
| WO | 2009/078093 | 6/2009 |
| WO | WO2015/117410 | 8/2015 |

OTHER PUBLICATIONS

International Search Report dated May 27, 2017 in PCT/CN2017/074798 with English translation.
Office Action dated Apr. 9, 2019 in Korean Patent Application No. 10-2018-7012848.
Office Action dated Mar. 5, 2019 in Japanese Patent Application No. 2018-516116, with English translation.
Written Opinion issued in PCT/CN2017/074798 dated May 24, 2017.
Japanese Office Action dated Oct. 29, 2019 in Patent Application No. 2018-516116, with English translation.
Chinese Office Action dated Dec. 13, 2019 in Chinese Patent Application No. 201610257244.7, with concise English translation.
European Search Report dated Nov. 19, 2019 in European Patent Application No. 17785258.9.

* cited by examiner

VOICE DETECTION METHOD AND APPARATUS, AND STORAGE MEDIUM

RELATED APPLICATION

This application is a continuation of International Application No. PCT/CN2017/074798, filed on Feb. 24, 2017, which claims priority to Chinese Patent Application No. 201610257244.7, entitled "VOICE DETECTION METHOD AND APPARATUS" filed on Apr. 22, 2016. The entire disclosures of the prior applications are hereby incorporated by reference in their entirety.

FIELD OF THE TECHNOLOGY

Embodiments of the present disclosure relate to voice detection techniques.

BACKGROUND OF THE DISCLOSURE

Currently, to simplify operations and improve user experience, voice signals are used for control mechanisms in many fields. For example, a voice signal is used as a voice input password. However, in a related technology, generally voice detection to a voice signal extracts a single characteristic from an input signal. The single characteristic extracted in this way is often relatively sensitive to a noise, and an interference sound cannot be accurately distinguished from a voice signal, thereby causing voice detection accuracy to reduce.

For the foregoing problem, no effective solution is currently provided.

SUMMARY

Aspects of the present disclosure provide a voice detection method. An audio signal can be divided into a plurality of audio segments. Audio characteristics from each of the plurality of audio segments can then be extracted. The audio characteristics of the respective audio segment include at least a time domain characteristic and a frequency domain characteristic of the respective audio segment. At least one target voice segment can be detected from the plurality of audio segments according to the audio characteristics of the plurality of audio segments.

Aspects of the present disclosure further provide a voice detection apparatus implementing the voice detection method. For example, the voice detection apparatus is an information processing apparatus that includes circuitry. The circuitry is configured to divide an audio signal into a plurality of audio segments and extract audio characteristics from each of the plurality of audio segments. The audio characteristics of the respective audio segment include a time domain characteristic and a frequency domain characteristic of the respective audio segment. The circuitry is further configured to detect at least one target voice segment from the plurality of audio segments according to the audio characteristics of the plurality of audio segments.

Aspects of the present disclosure further provide a non-transitory computer-readable medium storing a program implementing the voice detection method. For example, the non-transitory computer-readable medium stores a program executable by a processor to divide an audio signal into a plurality of audio segments and extract audio characteristics from each of the plurality of audio segments. The audio characteristics of the respective audio segment include a time domain characteristic and a frequency domain characteristic of the respective audio segment. Further, the program is executable by the processor to detect at least one target voice segment from the plurality of audio segments according to the audio characteristics of the plurality of audio segments.

In some embodiments of the present disclosure, an audio signal is divided into a plurality of audio segments, and audio characteristics in each of the audio segments are extracted, where the audio characteristics include at least a time domain characteristic and a frequency domain characteristic of the audio segment. Accordingly, an integration of a plurality of characteristics of an audio segment in different domains can be employed to accurately detect a target voice segment from the plurality of audio segments. As a result, interference of a noise signal in the audio segments can be reduced, thereby achieving an objective of increasing voice detection accuracy. In addition, the processing method solves a problem in a related technology that detection accuracy is relatively low due to a manner in which voice detection is performed by using only a single characteristic.

Further, when the target voice segments are accurately detected, a human-computer interaction device can further determine, in real time, a starting moment and an ending moment of a voice segment formed by the target voice segments. As a result, the human-computer interaction device can accurately respond to a detected voice in real time, and an effect of natural human-computer interaction can be achieved. In addition, by accurately detecting the starting moment and the ending moment of the voice segment formed by the target voice segments, the human-computer interaction device can further resolve a problem in a related technology that the human-computer interaction efficiency is relatively low because an interaction person presses a control button to trigger a human-computer interaction starting process.

BRIEF DESCRIPTION OF THE DRAWINGS

The accompanying drawings described herein are used to provide further understanding about the present disclosure, and form a portion of this application. Schematic embodiments of the present disclosure and descriptions about the exemplary embodiments are used to construe the present disclosure, and do not constitute an inappropriate limitation on the present disclosure. In the figures.

DESCRIPTION OF EMBODIMENTS

Figure 1:
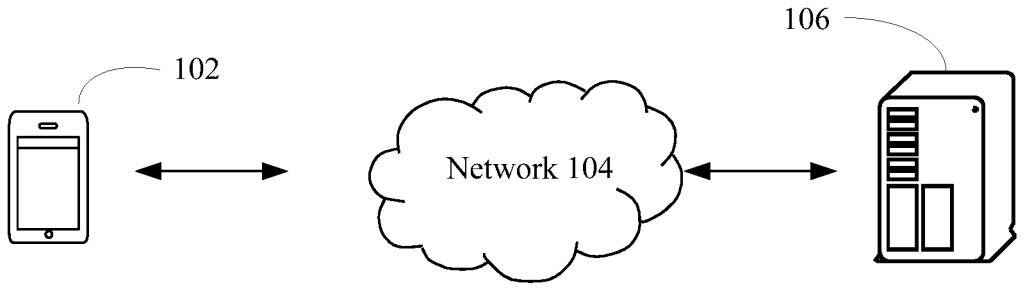
FIG. 1 is a schematic diagram of an application environment of an optional voice detection method according to an embodiment of the present disclosure.

To make a person skilled in the art understand the solutions in the present disclosure better, the following clearly describes the technical solutions in the embodiments of the present disclosure with reference to the accompanying drawings in the embodiments of the present disclosure. The described embodiments are merely some but not all of the embodiments of the present disclosure. All other embodiments obtained by a person of ordinary skill in the art based on the embodiments of the present disclosure shall fall within the protection scope of the present disclosure.

It should be noted that, the terms such as "first" and "second" in the specification and claims of the present disclosure and the accompanying drawings are used to distinguish similar objects, but are not necessarily used to describe a specific sequence or a precedence level. It should be understood that, data used in this way may be interchanged in a proper circumstance, so that the embodiments of the present disclosure described herein can be implemented in a sequence different from those shown in the drawings or described herein. In addition, terms "include" and "have" and any variation thereof are intended to cover nonexclusive including. For example, a process, method, system, product, or device including a series of steps or units are not limited to those clearly listed steps or units, but may include another step or unit that is not clearly listed or is inherent for the process, method, product or device.

Embodiment 1

According to an embodiment of the present disclosure, an embodiment of a voice detection method is provided. Optionally, in this embodiment, the voice detection method may be but is not limited to being applied to an application environment shown in FIG. 1. A terminal 102 obtains a to-be-detected audio signal, and sends the to-be-detected audio signal to a server 106 by using a network 104; and the server 106 divides the to-be-detected audio signal into a plurality of audio segments, extracts an audio characteristic in each of the audio segments, where the extracted audio characteristic includes at least a time domain characteristic and a frequency domain characteristic of the audio segment, and detects a target voice segment from the audio segment according to the extracted audio characteristic of the audio segment. A plurality of characteristics that are of an audio segment and that are at least in a time domain and a frequency domain are integrated. Based on complementarities of the characteristics, target voice segments can be accurately detected from a plurality of audio segments of an audio signal, thereby ensuring accuracy of detecting a voice segment formed by the detected target voice segments.

Figure 2:
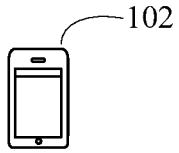
FIG. 2 is a schematic diagram of an application environment of another optional voice detection method according to an embodiment of the present disclosure.

Optionally, in this embodiment, the voice detection method may be further but is not limited to being applied to an application environment shown in FIG. 2. That is, after the terminal 102 obtains the to-be-detected audio signal, the terminal 102 performs an audio segment detection process in the voice detection method. The specific process may be shown in the foregoing, and details are not described herein again.

It should be noted that, in this embodiment, the terminal shown in FIG. 1 or FIG. 2 is only an example. Optionally, in this embodiment, the terminal 102 may include but is not limited to at least one of the following: a mobile phone, a tablet computer, a notebook computer, a desktop PC, a digital television, or another human-computer interaction device. The foregoing is only an example, and this is not limited in this embodiment. Optionally, in this embodiment, the foregoing network 104 may include but is not limited to at least one of the following: a wide area network, a metropolitan area network, or a local area network. The foregoing is only an example, and this is not limited in this embodiment.

Figure 3:
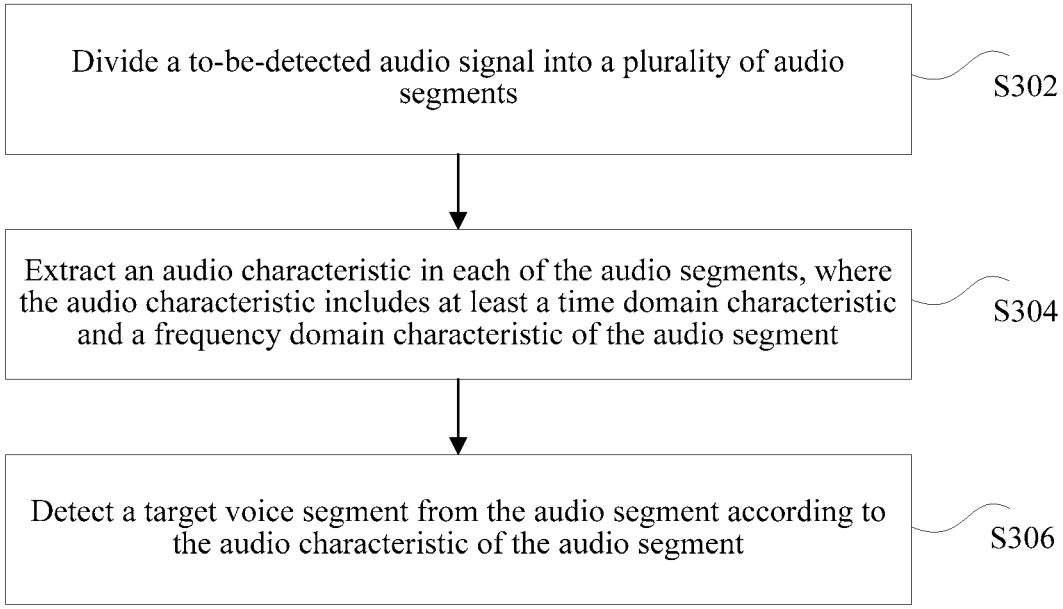
FIG. 3 is a schematic flowchart of an optional voice detection method according to an embodiment of the present disclosure.

According to an embodiment of the present disclosure, a voice detection method is provided. As shown in FIG. 3, the method includes:

S302: Divide a to-be-detected audio signal into a plurality of audio segments.

S304: Extract an audio characteristic in each of the audio segments, where the audio characteristic includes at least a time domain characteristic and a frequency domain characteristic of the respective audio segment.

S306: Detect target voice segments from the audio segments according to the extracted audio characteristics of the audio segments. In other words, according to an extracted audio characteristic of an audio segment, an audio signal corresponding to this audio segment can be determined to be a voice signal, thus this audio segment can be determined to be a target voice segment, and can be identified from the plurality of audio segments. Multiple target voice segments can be identified from the plurality of audio segments forming a voice segment, and provided for further processing (e.g., interpreting meaning carried in the voice segment).

Optionally, in this embodiment, the voice detection method may be but is not limited to being applied to at least one of the following scenarios: an intelligent robot chat system, an automatic question-answering system, human-computer chat software, or the like. That is, in a process of applying the voice detection method provided in this embodiment to human-computer interaction, by extracting an audio characteristic in an audio segment that includes characteristics at least in a time domain and a frequency domain, target voice segments in a plurality of audio segments of a to-be-detected audio signal can be accurately detected, so that a device used for human-computer interaction can learn a starting moment and an ending moment of a voice segment formed by the detected target voice segments, and the device can accurately respond after obtaining complete voice information carried in the to-be-detected audio signal. Herein, in this embodiment, the voice segment formed by the detected target voice segments may include but is not limited to: a target voice segment or a plurality of consecutive target voice segments. Each target voice segment includes a starting moment and an ending moment of the target voice segment. This is not limited in this embodiment.

It should be noted that, in this embodiment, a human-computer interaction device can divide a to-be-detected audio signal into a plurality of audio segments, and extract an audio characteristic in each of the audio segments which includes at least a time domain characteristic and a frequency domain characteristic of the audio segment, thereby implementing integration of a plurality of characteristics of an audio segment and in different domains to accurately detect target voice segments from the plurality of audio segments. During this process, interference of a noise signal in the audio segments to a voice detection process can be reduced, thereby achieving an objective of increasing voice detection accuracy, and resolving a problem in a related technology that detection accuracy is relatively low because voice detection is performed by using only a single characteristic.

Further, when the target voice segments are accurately detected, a human-computer interaction device can further quickly determine, in real time, a starting moment and an ending moment of a voice segment formed by the detected target voice segments, so that the human-computer interaction device accurately responds, in real time, to voice information obtained by means of detection, and an effect of natural human-computer interaction is achieved. In addition, by accurately detecting the starting moment and the ending moment of the voice segment formed by the target voice segments, the human-computer interaction device further achieves an effect of increasing human-computer interaction efficiency, and resolves a problem in a related technology that the human-computer interaction efficiency is relatively low because an interaction person presses a control button to trigger a human-computer interaction starting process.

Optionally, in this embodiment, the audio characteristic may include but is not limited to at least one of the following: a signal zero-crossing rate in a time domain, short-time energy in a time domain, spectral flatness in a frequency domain, or signal information entropy in a time domain, a self-correlation coefficient, a signal after wavelet transform, signal complexity, or the like.

It should be noted that, 1) the signal zero-crossing rate may be but is not limited to being used to eliminate interference from some impulse noises; 2) the short-time energy may be but is not limited to being used to measure an amplitude value of the audio signal, and eliminate interference from speech voices of an unrelated population with reference to a threshold; 3) the spectral flatness may be but is not limited to being used to calculate, within a frequency domain, a signal frequency distribution feature, and determine whether the audio signal is a background white Gaussian noise according to a value of the characteristic; 4) the signal information entropy in the time domain may be but is not limited to being used to measure an audio signal distribution feature in the time domain, and the characteristic is used to distinguish a voice signal from a common noise. In this embodiment, the plurality of characteristics in the time domain and the frequency domain are integrated into a voice detection process to resist interference from an impulse noise or a background noise, and enhance robustness, so as to accurately detect a target voice segment from a plurality of audio segments of a to-be-detected audio signal, and accurately obtain a starting moment and an ending moment of a voice segment formed by the target voice segments, to implement natural human-computer interaction.

Optionally, in this embodiment, a manner of detecting a target voice segment from a plurality of audio segments in an audio signal according to an audio characteristic of an audio segment may include but is not limited to: determining whether the audio characteristic of the audio segment satisfies a predetermined threshold condition; when the audio characteristic of the audio segment satisfies the predetermined threshold condition, detecting (determining) that the audio segment is the target voice segment.

It should be noted that, in this embodiment, when whether the audio characteristic of the audio segment satisfies the predetermined threshold condition is determined, a current audio segment used for the determining may be obtained from the plurality of audio segments according to at least one of the following sequences: 1) according to an input sequence of the audio signal; 2) according to a predetermined sequence. The predetermined sequence may be a random sequence, or may be a sequence arranged according to a predetermined rule, for example, according to a sequence of sizes of the audio segments. The foregoing is only an example, and this is not limited in this embodiment.

In addition, in this embodiment, the predetermined threshold condition may be but is not limited to performing adaptive update and adjustment according to varying scenarios. The predetermined threshold condition used to compare with the audio characteristic is constantly updated, to ensure that the target voice segment is accurately detected from the plurality of audio segments in a detection process according to different scenarios. Further, for a plurality of characteristics that is of an audio segment and that is in a plurality of domains, whether corresponding predetermined threshold conditions are satisfied is separately determined, to perform determining and screening on the audio segment for a plurality of times, thereby ensuring that a target voice segment is accurately detected.

Optionally, in this embodiment, when an audio segment is obtained from a plurality of audio segments according to an input sequence of an audio signal, to determine whether an audio characteristic of the audio segment satisfies a predetermined threshold condition, the detecting a target voice segment from the audio segment according to the audio characteristic of the audio segment includes: repeatedly performing the following steps, until a current audio segment is a last audio segment in the plurality of audio segments, where the current audio segment is initialized as a first audio segment in the plurality of audio segments:

S1: Determine whether an audio characteristic of the current audio segment satisfies a predetermined threshold condition.

S2: When the audio characteristic of the current audio segment satisfies the predetermined threshold condition, detect that the current audio segment is the target voice segment.

S3: When the audio characteristic of the current audio segment does not satisfy the predetermined threshold condition, update the predetermined threshold condition according to at least the audio characteristic of the current audio segment, to obtain the updated predetermined threshold condition.

S4: Determine whether the current audio segment is the last audio segment in the plurality of audio segments, and if the current audio segment is not the last audio segment, use a next audio segment of the current audio segment as the current audio segment.

It should be noted that, in this embodiment, the predetermined threshold condition may be but is not limited to being updated according to at least an audio characteristic of a current audio segment, to obtain an updated predetermined threshold condition. That is, when the predetermined threshold condition is updated, a predetermined threshold condition needed by a next audio segment is determined according to an audio characteristic of a current audio segment (a historical audio segment), so that an audio segment detection process is more accurate.

Optionally, in this embodiment, after the dividing a to-be-detected audio signal into a plurality of audio segments, the method further includes:

S1: Obtain first N audio segments in the plurality of audio segments, where N is an integer greater than 1.

S2: Construct a noise suppression model according to the first N audio segments, where the noise suppression model is used to perform noise suppression processing on an $N+^{th}$ audio segment and an audio segment thereafter in the plurality of audio segments.

S3: Obtain an initial predetermined threshold condition according to the first N audio segments.

It should be noted that, to ensure accuracy of the voice detection process, in this embodiment, noise suppression processing is performed on the plurality of audio segments, to prevent interference of a noise to a voice signal. For example, a background noise of an audio signal is eliminated in a manner of minimum mean-square error logarithm spectral amplitude estimation.

Optionally, in this embodiment, the first N audio segments may be but are not limited to audio segments without voice input. That is, before a human-computer interaction process is started, an initialization operation is performed, a noise suppression model is constructed by using the audio segments without voice input, and an initial predetermined threshold condition used to determine an audio characteristic. The initial predetermined threshold condition may be but is not limited to being determined according to an average value of audio characteristics of the first N audio segments.

Optionally, in this embodiment, before the extracting an audio characteristic in each of the audio segments, the method further includes: performing a second quantization on the collected audio signal, where a quantization level of the second quantization is less than a quantization level of a first quantization.

It should be noted that, in this embodiment, the first quantization may be but is not limited to being performed when the audio signal is collected; and the second quantization may be but is not limited to being performed after the noise suppression processing is performed. In addition, in this embodiment, a higher quantization level indicates more sensitive interference; that is, when a quantization level is relatively large, a quantization interval is relatively small, and therefore a quantization operation is performed on a relatively small noise signal; in this way, a result after the quantization not only includes a voice signal, but also includes a noise signal, and very large interference is caused to voice signal detection. In this embodiment, quantization is implemented twice by adjusting quantization levels, that is, the quantization level of the second quantization is less than the quantization level of the first quantization, thereby filtering a noise signal twice, to reduce interference.

Optionally, in this embodiment, the dividing a to-be-detected audio signal into a plurality of audio segments may include but is not limited to: collecting the audio signal by using a sampling device with a fixed-length window. In this embodiment, a length of the fixed-length window is relatively small. For example, a length of a used window is 256 (signal quantity). That is, the audio signal is divided by using a small window, so as to return a processing result in real time, to complete real-time detection of a voice signal.

According to this embodiment provided by this application, a to-be-detected audio signal is divided into a plurality of audio segments, and an audio characteristic in each of the audio segments is extracted, where the audio characteristic includes at least a time domain characteristic and a frequency domain characteristic of the audio segment, thereby implementing integration of a plurality of characteristics that is of an audio segment and that is in different domains to accurately detect a target voice segment from the plurality of audio segments, so as to reduce interference of a noise signal in the audio segments to a voice detection process, thereby achieving an objective of increasing voice detection accuracy, and resolving a problem in a related technology that detection accuracy is relatively low due to a manner in which voice detection is performed by using only a single characteristic.

As an optional solution, the detecting a target voice segment from the audio segment according to the audio characteristic of the audio segment includes:

S1: Determine whether the audio characteristic of the current audio segment satisfies a predetermined threshold condition, where the audio characteristic of the audio segment includes: a signal zero-crossing rate of the current audio segment in a time domain, short-time energy of the current audio segment in a time domain, spectral flatness of the current audio segment in a frequency domain, or signal information entropy of the current audio segment in a time domain.

S2: When the audio characteristic of the current audio segment satisfies the predetermined threshold condition, detect that the current audio segment is the target voice segment.

Optionally, in this embodiment, audio characteristics of a current audio segment x (i) in N audio segments may be obtained by using the following formulas:

1) Calculate a signal zero-crossing rate (that is, a short-time zero-crossing rate) in a time domain:

$$Z_n = \frac{1}{2N}\sum_{i=0}^{N-1}|sgn(x(i)) - sgn(x(i-1))| \tag{1}$$

where sgn[ ] is a symbol function:

$$sgn[x] = \begin{cases} 1 & x \geq 0 \\ -1 & x < 0 \end{cases} \tag{2}$$

2) Calculate short-time energy in a time domain:

$$E_n = \Sigma_{i=0}^{N-1} x^2(i) h(N-i) \tag{3}$$

where h[i] is a window function, and the following function can be used:

$$h[i] = \begin{cases} 1/N & 0 \leq i \leq N-1 \\ 0 & i \text{ is another value} \end{cases} \tag{4}$$

3) Calculate spectral flatness in a frequency domain:

First, Fourier transformation is performed on the audio segment x(i) i=0, 1, 2 . . . , N−1 to obtain an amplitude value f(i) i=0, 1, 2 . . . , N−1 in the frequency domain.

The spectral flatness is calculated according to the following formula:

$$F_n = \frac{\sqrt[n]{\prod_{i=0}^{n-1} f(i)}}{\frac{\sum_{i=0}^{n-1} f(i)}{n}} = \frac{\exp\left(\frac{1}{N}\sum_{i=0}^{N-1} Inf(i)\right)}{\frac{1}{N}\sum_{i=0}^{N-1} f(i)} \quad (5)$$

4) Calculate signal information entropy in a time domain:

First, a value of a relative probability after a signal absolute value is normalized is calculated:

$$p(i) = \frac{|x(i)|}{\sum_{i=0}^{N-1} |x(i)|} \quad (6)$$

The signal information entropy is then calculated according to the following formula:

$$I_n = \Sigma_{i=0}^{N-1} p(i) \log_2 p(i) \quad (7)$$

Figure 4:
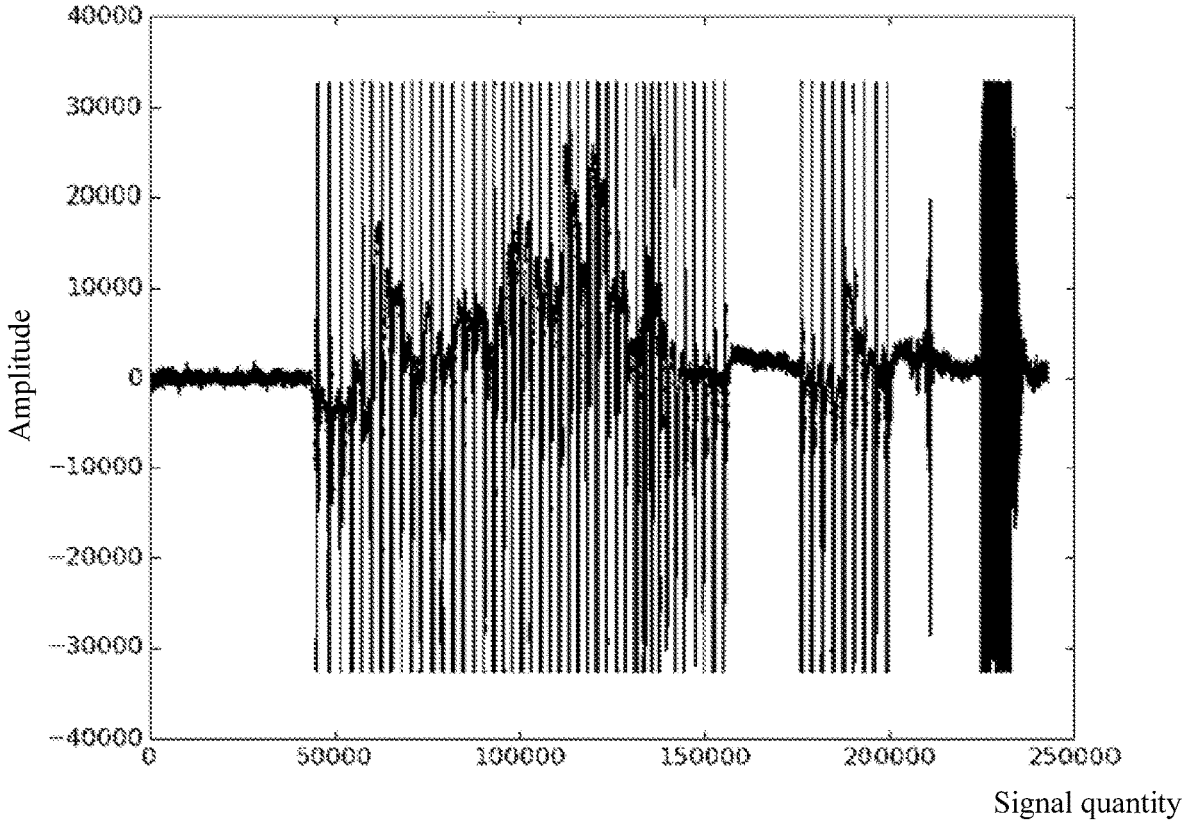
FIG. 4 is a schematic waveform diagram of an optional voice detection method according to an embodiment of the present disclosure.
Figure 5:
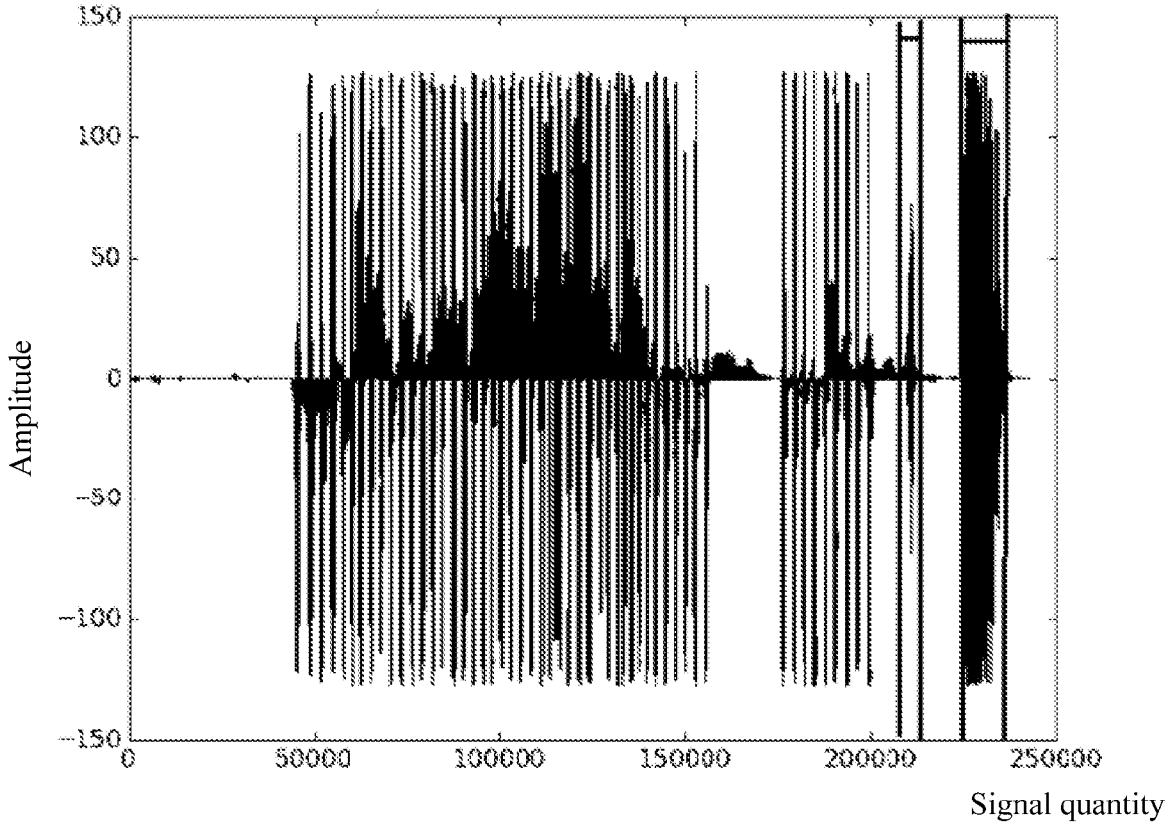
FIG. 5 is a schematic waveform diagram of another optional voice detection method according to an embodiment of the present disclosure.
Figure 6:
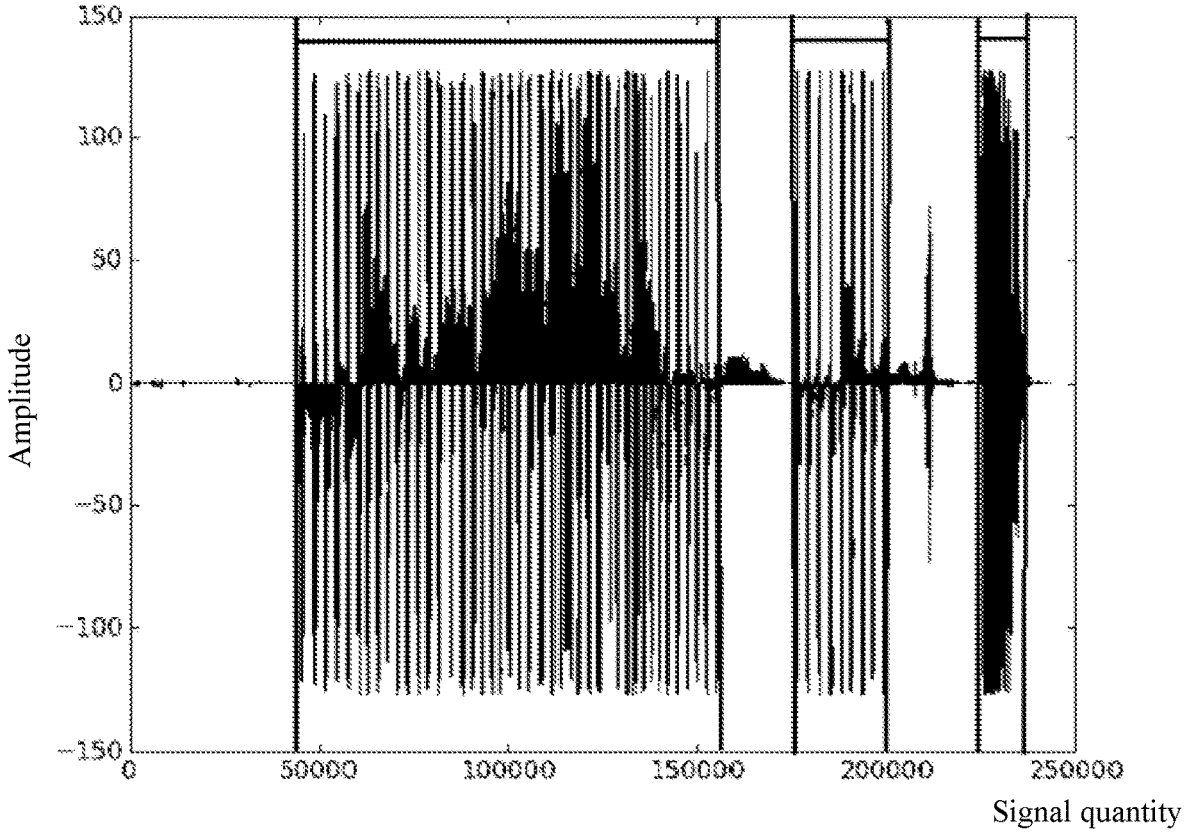
FIG. 6 is a schematic waveform diagram of still another optional voice detection method according to an embodiment of the present disclosure.
Figure 7:
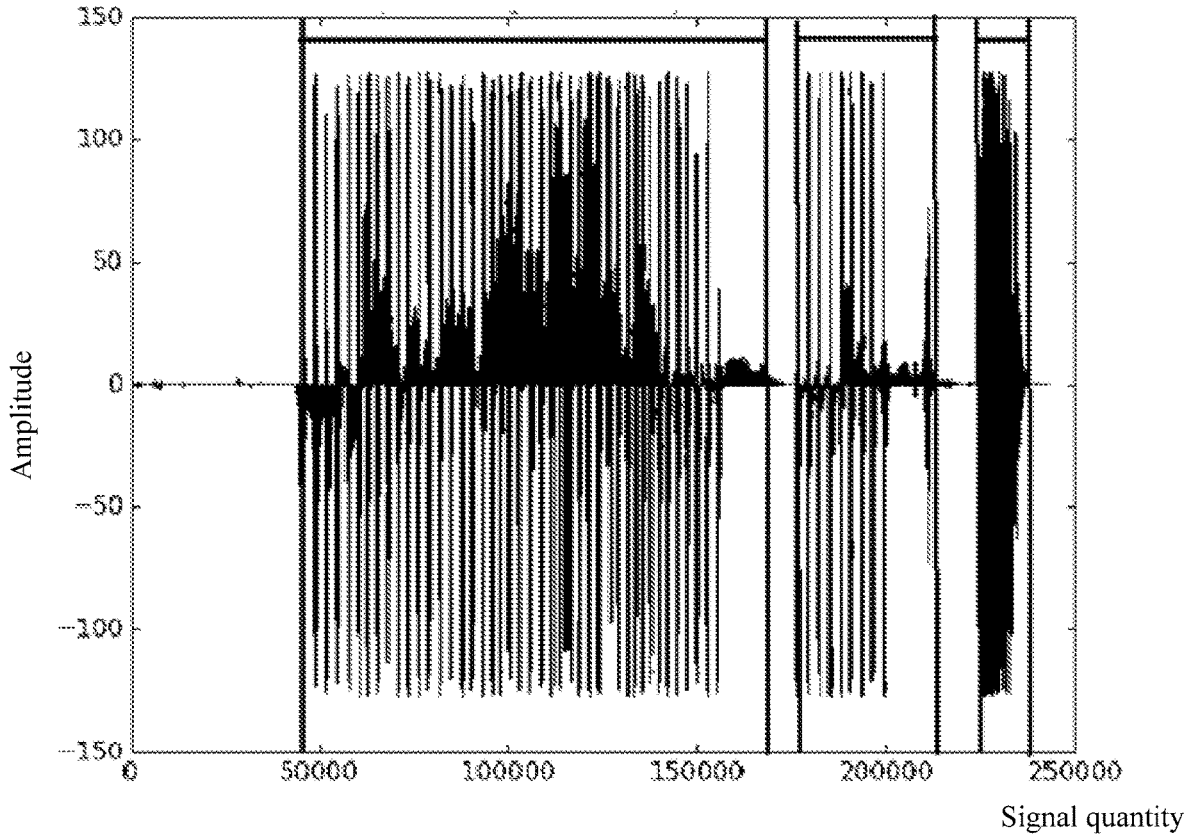
FIG. 7 is a schematic waveform diagram of still another optional voice detection method according to an embodiment of the present disclosure.
Figure 8:
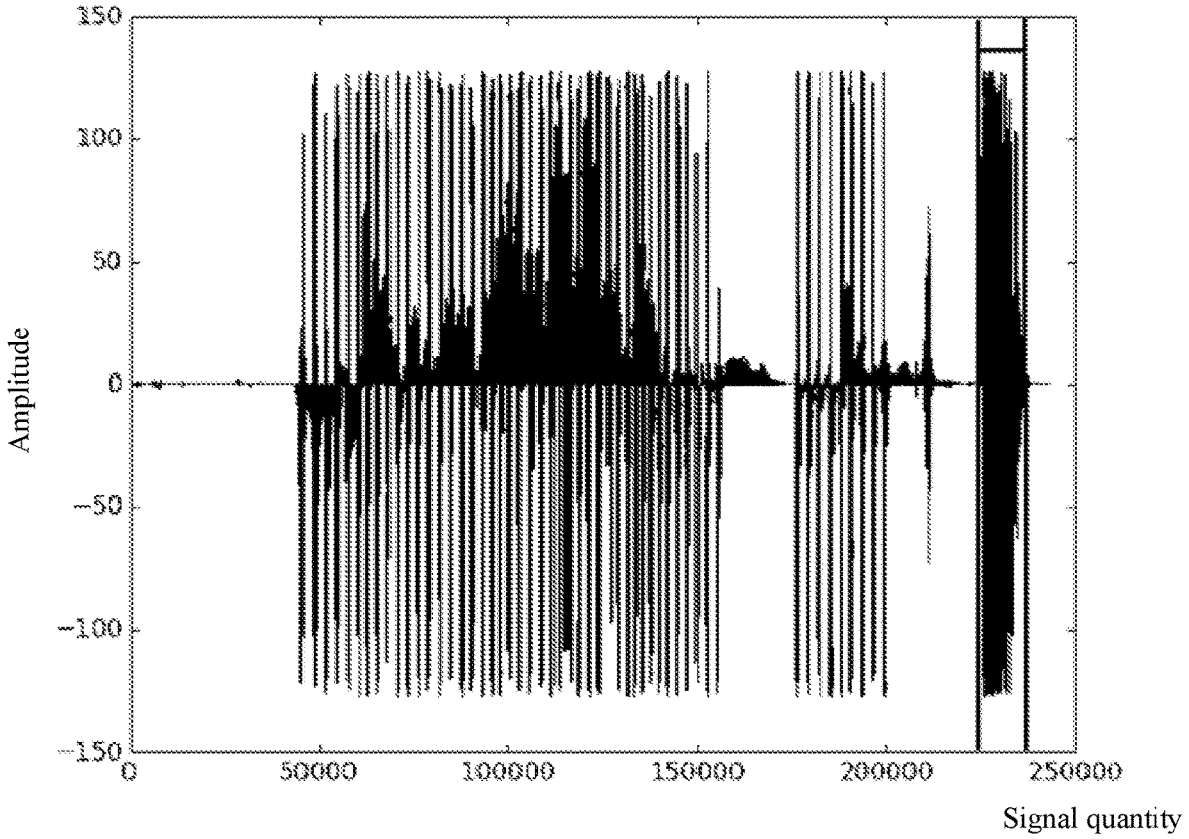
FIG. 8 is a schematic waveform diagram of still another optional voice detection method according to an embodiment of the present disclosure.

Specifically, a description is provided with reference to the following example. FIG. 4 shows original audio signals with impulse noises. There are some impulse noises in an intermediate section (signals within a range of 50000 to 150000 on the horizontal axis), and voice signals are in a last section (signals within a range of 230000 to 240000 on the horizontal axis). FIG. 5 shows audio signals for which signal zero-crossing rates are separately extracted from original audio signals. It can be seen that, an impulse noise can be well distinguished according to a characteristic of the signal zero-crossing rate. For example, impulse noises in an intermediate section (signals within a range of 50000 to 150000 on the horizontal axis) can be directly filtered out; however, low-energy non-impulse noises (signals within a range of 210000 to 220000 on the horizontal axis) cannot be distinguished. FIG. 6 shows audio signals for which short-time energy is separately extracted from original audio signals. It can be seen that, by using a characteristic of the short-time energy, low-energy non-impulse noises (signals within a range of 210000 to 220000 on the horizontal axis) can be filtered out; however, impulse noises (impulse signals also have relatively large energy) in an intermediate section (signals within a range of 50000 to 150000 on the horizontal axis) cannot be distinguished. FIG. 7 shows audio signals for which spectral flatness and signal information entropy are extracted from original audio signals. By using the two, both voice signals and impulse noises can be detected, and all voice like signals can be reserved to the greatest extent. Further, FIG. 8 shows a manner provided in this embodiment: based on the extraction of the spectral flatness and the signal information entropy, with reference to the characteristic of the short-time energy and the characteristic of the signal zero-crossing rate, interference from an impulse noise and another low-energy noise can be distinguished, and an actual voice signal can be detected. It can be known from the signals shown in the foregoing figures that, an audio signal extracted in this embodiment is more beneficial to accurate detection of a target voice segment.

According to this embodiment provided by this application, the plurality of characteristics in the time domain and the frequency domain are integrated into a voice detection process to resist interference from an impulse noise or a background noise, and enhance robustness, so as to accurately detect a target voice segment from a plurality of audio segments into which a to-be-detected audio signal is divided, and accurately obtain a starting moment and an ending moment of a voice signal corresponding to the target voice segment, to implement natural human-computer interaction.

As an optional solution, the detecting a target voice segment from the audio segment according to the audio characteristic of the audio segment includes:

S1: Repeatedly perform the following steps, until a current audio segment is a last audio segment in the plurality of audio segments, where the current audio segment is initialized as a first audio segment in the plurality of audio segments:

S11: Determine whether an audio characteristic of the current audio segment satisfies a predetermined threshold condition.

S12: When the audio characteristic of the current audio segment satisfies the predetermined threshold condition, detect that the current audio segment is the target voice segment.

S13: When the audio characteristic of the current audio segment does not satisfy the predetermined threshold condition, update the predetermined threshold condition according to at least the audio characteristic of the current audio segment, to obtain the updated predetermined threshold condition.

S14: Determine whether the current audio segment is the last audio segment in the plurality of audio segments, and if the current audio segment is not the last audio segment, use a next audio segment of the current audio segment as the current audio segment.

Optionally, in this embodiment, the predetermined threshold condition may be but is not limited to performing adaptive update and adjustment according to varying scenarios. In this embodiment, when an audio segment is obtained from a plurality of audio segments according to an input sequence of an audio signal, to determine whether an audio characteristic of the audio segment satisfies a predetermined threshold condition, the predetermined threshold condition may be but is not limited to being updated according to at least an audio characteristic of a current audio segment. That is, when the predetermined threshold condition needs to be updated, a next updated predetermined threshold condition is obtained based on the current audio segment (a historical audio segment).

It should be noted that, for a to-be-detected audio signal, there are a plurality of audio segments, and the foregoing determining process is repeatedly performed for each audio segment, until the plurality of audio segments to which the to-be-detected audio signal is divided is traversed, that is, until the current audio segment is a last audio segment in the plurality of audio segments.

According to this embodiment provided by this application, the predetermined threshold condition used to compare with the audio characteristic is constantly updated, to ensure that the target voice segment is accurately detected from the plurality of audio segments in a detection process according to different scenarios. Further, for a plurality of characteristics that is of an audio segment and that is in a plurality of domains, whether corresponding predetermined threshold conditions are satisfied is separately determined, to perform determining and screening on the audio segment for a plurality of times, thereby ensuring that an accurate target voice segment is detected.

As an optional solution:

S1: Determining whether an audio characteristic of the current audio segment satisfies a predetermined threshold condition includes: S11: Determine whether the signal zero-crossing rate of the current audio segment in a time domain is greater than a first threshold; when the signal zero-crossing rate of the current audio segment is greater than the first threshold, determine whether the short-time energy of the current audio segment in the time domain is greater than a second threshold; or when the short-time energy of the current audio segment is greater than the second threshold, determine whether the spectral flatness of the current audio segment in the frequency domain is less than a third threshold; and when the spectral flatness of the current audio segment in the frequency domain is less than the third threshold, determine whether the signal information entropy of the current audio segment in the time domain is less than a fourth threshold.

S2: When the audio characteristic of the current audio segment satisfies the predetermined threshold condition, detecting that the current audio segment is the target voice segment includes: S21: When determining that the signal information entropy of the current audio segment is less than the fourth threshold, detect that the current audio segment is the target voice segment.

Optionally, in this embodiment, the process of detecting a target voice segment according to a plurality of characteristics that is of a current audio segment and that is in a time domain and a frequency domain may be but is not limited to being performed after second quantization is performed on an audio signal. This is not limited in this embodiment.

It should be noted that, the audio characteristic has the following functions in a voice detection process:

1) signal zero-crossing rate: obtaining a signal zero-crossing rate that is of a current audio segment and that is in a time domain, where the signal zero-crossing rate indicates a quantity of times that a waveform of an audio signal crosses the zero axis, and generally, a zero-crossing rate of a voice signal is greater than a zero-crossing rate of a non-voice signal;

2) short-time energy: obtaining time domain energy that is of a current audio segment and that is in time domain amplitude, where the short-time energy is used to distinguish a non-voice signal from a voice signal in terms of signal energy, and generally, short-time energy of the voice signal is greater than short-time energy of the non-voice signal;

3) spectral flatness: performing Fourier transformation on a current audio segment and calculating spectral flatness thereof, where frequency distribution of a voice signal is relatively concentrative, and corresponding spectral flatness is relatively small; and frequency distribution of a white Gaussian noise signal is relatively dispersive, and corresponding spectral flatness is relatively large; and 4) signal information entropy: normalizing a current audio segment and then calculating signal information entropy, where distribution of a voice signal is relatively concentrative, and corresponding signal information entropy is small; and distribution of a non-voice signal, in particular, a white Gaussian noise is relatively dispersive, and corresponding signal information entropy is relatively large.

Figure 9:
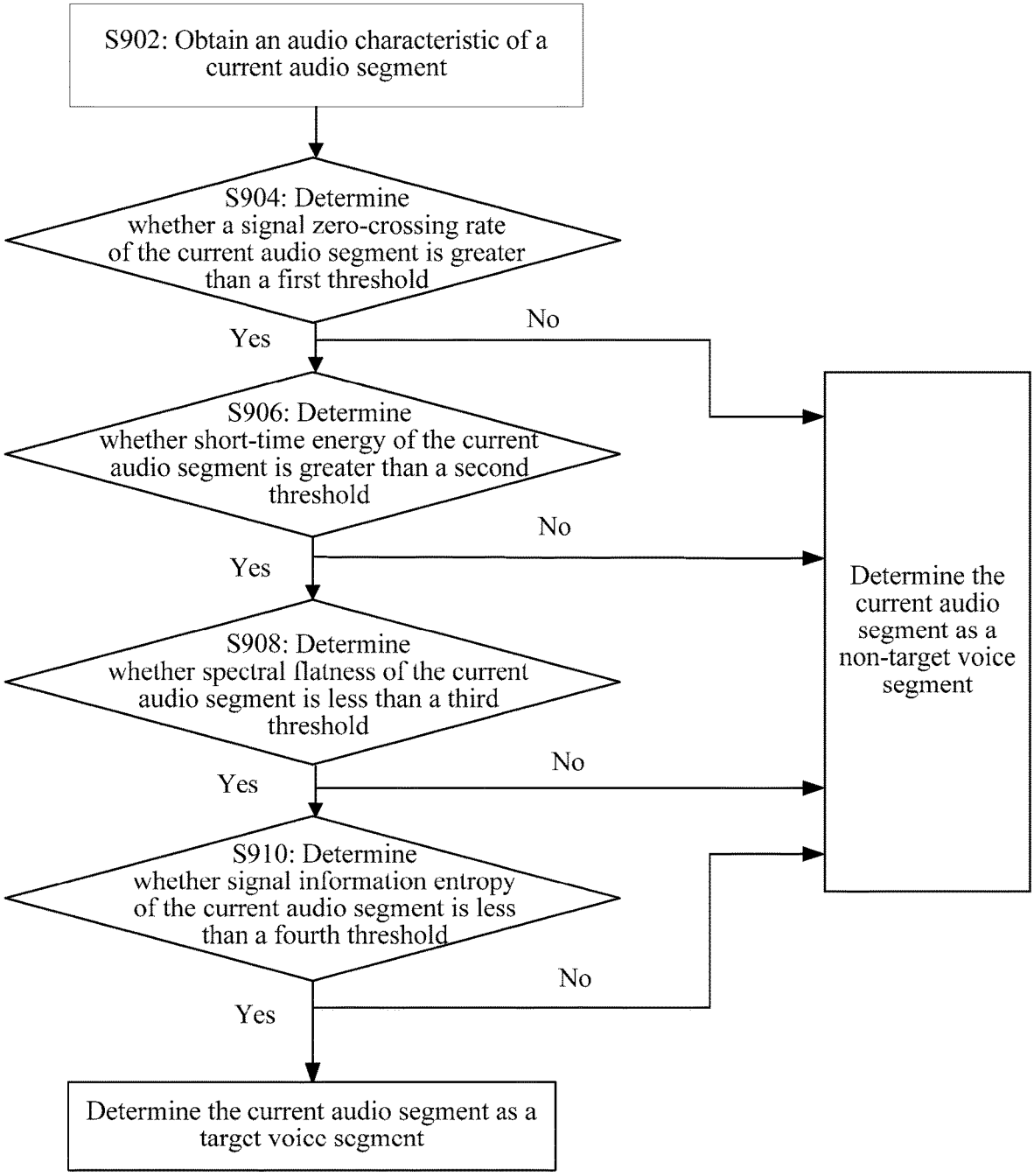
FIG. 9 is a schematic flowchart of another optional voice detection method according to an embodiment of the present disclosure.

Specifically, a description is provided with reference to the example shown in FIG. 9:

S902: Obtain an audio characteristic of a current audio segment.

S904: Determine whether a signal zero-crossing rate of the current audio segment is greater than a first threshold, and if the signal zero-crossing rate of the current audio segment is greater than the first threshold, perform a next operation; or if the signal zero-crossing rate of the current audio segment is less than or equal to the first threshold, directly determine the current audio segment as a non-target voice segment.

S906: Determine whether short-time energy of the current audio segment is greater than a second threshold, and if the short-time energy of the current audio segment is greater than the second threshold, perform a next step of determining; or if the short-time energy of the current audio segment is less than or equal to the second threshold, directly determine the current audio segment as a non-target voice segment, and update the second threshold according to the short-time energy of the current audio segment.

S908: Determine whether spectral flatness of the current audio segment is less than a third threshold, and if the spectral flatness of the current audio segment is less than the third threshold, perform a next step of determining; or if the spectral flatness of the current audio segment is greater than or equal to the third threshold, directly determine the current audio segment as a non-target voice segment, and update the third threshold according to the spectral flatness of the current audio segment.

S910: Determine whether signal information entropy of the current audio segment is less than a fourth threshold, and if the signal information entropy of the current audio segment is less than the fourth threshold, perform a next step of determining; or if the signal information entropy of the current audio segment is greater than or equal to the fourth threshold, directly determine the current audio segment as a non-target voice segment, and update the fourth threshold according to the spectral flatness of the current audio segment.

After step S910 is complete, when it is determined that all of the four characteristics satisfy the corresponding predetermined threshold conditions, the current audio segment is determined as the target voice segment.

According to this embodiment provided by this application, by integrating a plurality of characteristics that is of an audio segment and that is in different domains, a target voice segment is accurately detected from the plurality of audio segments, to reduce interference of a noise signal in the audio segment to a voice detection process, achieving an objective of increasing voice detection accuracy.

As an optional solution, the updating the predetermined threshold condition according to at least the audio characteristic of the current audio segment includes:

1) when the short-time energy of the current audio segment is less than or equal to the second threshold, updating the second threshold according to at least the short-time energy of the current audio segment; or 2) when the spectral flatness of the current audio segment is greater than or equal to the third threshold, updating the third threshold according to at least the spectral flatness of the current audio segment; or 3) when the signal information entropy of the current audio segment is greater than or equal to the fourth threshold, updating the fourth threshold according to at least the signal information entropy of the current audio segment.

Optionally, in this embodiment, the updating the predetermined threshold condition according to at least the audio characteristic of the current audio segment includes:

$$A=a\times A'+(1-a)\times B \tag{8}$$

where, a indicates an attenuation coefficient, and when B indicates the short-time energy of the current audio segment, A' indicates the second threshold, and A indicates the updated second threshold; when B indicates the spectral flatness of the current audio segment, A' indicates the third threshold, and A indicates the updated third threshold; or when B indicates the signal information entropy of the current audio segment, A' indicates the fourth threshold, and A indicates the updated fourth threshold.

That is, when the predetermined threshold condition is updated, a predetermined threshold condition needed by a next audio segment is determined according to an audio characteristic of a current audio segment (a historical audio segment), so that a target voice detection process is more accurate.

According to this embodiment provided by this application, the predetermined threshold condition used to compare with the audio characteristic is constantly updated, to ensure that the target voice segment is accurately detected from the plurality of audio segments in a detection process according to different scenarios.

As an optional solution, after the detecting a target voice segment from the audio segment according to the audio characteristic of the audio segment, the method further includes:

S1: Determine, according to one or more locations of the one or more target voice segments in the plurality of audio segments, a starting moment and an ending moment of a continuous voice segment formed by the one or more target voice segments.

Optionally, in this embodiment, the voice segments may include but is not limited to: a target voice segment or a plurality of consecutive target voice segments. Each target voice segment includes a starting moment of the target voice segment and an ending moment of the target voice segment.

It should be noted that, in this embodiment, when the target voice segment is detected from the plurality of audio segments, a starting moment and an ending moment of a voice segment formed by the target voice segment may be obtained according to a time label of the target voice segment, for example, the starting moment of the target voice segment and the ending moment of the target voice segment.

Optionally, in this embodiment, the determining, according to a location that is of the target voice segment and that is in the plurality of audio segments, a starting moment and an ending moment of a continuous voice segment formed by the target voice segment includes:

S1: Obtain a starting moment of a first target voice segment in K consecutive target voice segments, and use the starting moment of the first target voice segment as the starting moment of the continuous voice segment.

S2: After the starting moment of the continuous voice segment is confirmed, obtain a starting moment of a first non-target voice segment in M consecutive non-target voice segments after a $K^{th}$ target voice segment, and use the starting moment of the first non-target voice segment as the ending moment of the continuous voice segment.

Optionally, in this embodiment, K is an integer greater than or equal to 1, and M may be set to different values according to different scenarios. This is not limited in this embodiment.

Specifically, a description is provided with reference to the following example. It is assumed that, target voice segments detected from a plurality of (for example, 20) audio segments (it is assumed that each duration is T) include P1 to P5, P7 to P8, P10, and P17 to P20. Further, it is assumed that M is 5.

It can be known based on the foregoing assumptions that, the first five target voice segments are consecutive, there is a non-target voice segment (that is, P6) between P5 and P7, there is a non-target voice segment (that is, P9) between P8 and P10, and there are six non-target voice segments (that is, P11 to P16) between P10 and P17.

It can be confirmed according to first K (that is, first five) consecutive target voice segments that: a voice segment A including a voice signal is detected from a to-be-detected audio signal, where a starting moment of the voice segment A is a starting moment (that is, a starting moment of P1) of a first target voice segment in the first five target voice segments. Further, a quantity of non-target voice segments between P5 and P7 is 1, that is, less than M (M=5), and a quantity of non-target voice segments between P8 and P10 is 1, that is, less than M (M=5). Therefore, it can be determined that, the foregoing voice segment A is not ended at the non-target voice segment P6 and the non-target voice segment P9. A quantity of non-target voice segments between P10 and P17 is 6, that is, greater than M (M=5), that is, a quantity of consecutive non-target voice segments (P11 to P16) already satisfies M preset thresholds. Therefore, it can be determined that the voice segment A is ended at a starting moment (that is, a starting moment of P11) of a first non-target voice segment in the consecutive non-target voice segments (that is, P11 to P16), and then the starting moment of P11 is used as an ending moment of the voice segment A. That is, the starting moment of the voice segment A is a starting moment 0 of P1, and the ending moment is a starting moment 10 T of P11.

Herein, it should be noted that, in this example, the foregoing consecutive target voice segments P17 to P20 are used to determine a detection process of a next voice segment B. The detection process may be performed by referring to the foregoing process, and details are not described herein again in this embodiment.

In addition, in this embodiment, a to-be-detected audio signal may be but is not limited to being obtained in real time, so as to detect whether an audio segment in an audio signal is a target voice segment, thereby accurately detecting a starting moment of a voice segment formed by the target voice segment and an ending moment of the voice segment, and implementing that a human-computer interaction device can accurately reply after obtaining complete voice information that needs to be expressed by the voice segment, to implement human-computer interaction. It should be noted that, in a process of obtaining the to-be-detected audio signal in real time, voice detection may be but is not limited to repeatedly performing the foregoing detection steps. In this embodiment, details are not described herein again.

According to this embodiment provided by this application, when the target voice segment is accurately detected, a human-computer interaction device can further quickly determine, in real time, a starting moment and an ending moment of a voice segment formed by the target voice segment(s), so that the human-computer interaction device accurately responds, in real time, to voice information obtained by means of detection, and an effect of natural human-computer interaction is achieved. In addition, by accurately detecting the starting moment and the ending moment of the voice signal corresponding to the target voice segment, the human-computer interaction device further achieves an effect of increasing human-computer interaction efficiency, and resolves a problem in a related technology that the human-computer interaction efficiency is relatively low because an interaction person presses a control button to trigger a human-computer interaction starting process.

As an optional solution, after the dividing a to-be-detected audio signal into a plurality of audio segments, the method further includes:

S1: Obtain first N audio segments in the plurality of audio segments, where N is an integer greater than 1.

S2: Construct a noise suppression model according to the first N audio segments, where the noise suppression model is used to perform noise suppression processing on an $N+^{th}$ audio segment and an audio segment thereafter in the plurality of audio segments.

S3: Obtain an initial predetermined threshold condition according to the first N audio segments.

For example, specifically, a noise suppression model is constructed according to first N audio segments in the following manner. It is assumed that an audio signal includes a pure voice signal and an independent white Gaussian noise. Then, noise suppression may be performed in the following manner: Fourier transformation is performed on background noises of the first N audio segments, to obtain signal frequency domain information; a frequency domain logarithm spectral characteristic of the noises is estimated according to the frequency domain information of the Fourier transformation, to construct the noise suppression model. Further, for an $N+1^{th}$ audio segment and an audio segment thereafter, it may be but is not limited to performing noise elimination processing on audio signals based on the noise suppression model and by using a maximum likelihood estimation method.

For another example, before a human-computer interaction process is started, an initialization operation is performed, a noise suppression model is constructed by using the audio segments without voice input, and an initial predetermined threshold condition used to determine an audio characteristic. The initial predetermined threshold condition may be but is not limited to being determined according to an average value of audio characteristics of the first N audio segments.

According to this embodiment provided by this application, an initialization operation of human-computer interaction is implemented by using first N audio segments in a plurality of audio segments. For example, a noise suppression model is constructed, to perform noise suppression processing on the plurality of audio segments, preventing interference of a noise to a voice signal. For example, an initial predetermined threshold condition used to determine an audio characteristic is obtained, so as to perform voice detection on the plurality of audio segments.

As an optional solution, before the extracting an audio characteristic in each of the audio segments, the method further includes:

S1: Collect the to-be-detected audio signal, where first quantization is performed on the audio signal when the audio signal is collected.

S2: Perform second quantization on the collected audio signal, where a quantization level of the second quantization is less than a quantization level of the first quantization.

It should be noted that, in this embodiment, the first quantization may be but is not limited to being performed when the audio signal is collected; and the second quantization may be but is not limited to being performed after the noise suppression processing is performed. In addition, in this embodiment, a higher quantization level indicates more sensitive interference; that is, smaller interference indicates easier interference to a voice signal, and interference is implemented twice by adjusting quantization levels, to achieve an effect of filtering out the interference twice.

Specifically, a description is provided with reference to the following example. For example, during first quantization, 16 bits are used, and during second quantization, 8 bits are used, that is, a range of [−128-127], thereby accurately distinguishing a voice signal from a noise by means of filtering for a second time.

It should be noted that, according to the foregoing method embodiments, for brief descriptions, the method embodiments are described as a combination of a series of actions. However, a person skilled in the art should know that, the present disclosure is not limited by an action sequence that is described, because some steps may be performed in another sequence or simultaneously according to the present disclosure. In addition, a person skilled in the art should also know that all the embodiments described in this specification are exemplary embodiments, and the related actions and modules are not necessarily required in the present disclosure.

According to the foregoing descriptions of implementations, the person skilled in the art may clearly know that the method according to the foregoing embodiments may be implemented by using software and a general hardware platform, or certainly may be implemented by using hardware. However, in most cases, the former is an exemplary implementation. Based on such an understanding, the technical solutions of the present disclosure essentially, or the part contributing to a related technology may be implemented in a form of a software product. The computer software product is stored in a storage medium (such as a ROM/RAM, a magnetic disk, or an optical disc) and includes several instructions for instructing a terminal device (which may be a mobile phone, a computer, a server, a network device, or the like) to perform the methods described in the embodiments of the present disclosure.

Embodiment 2

Figure 10:
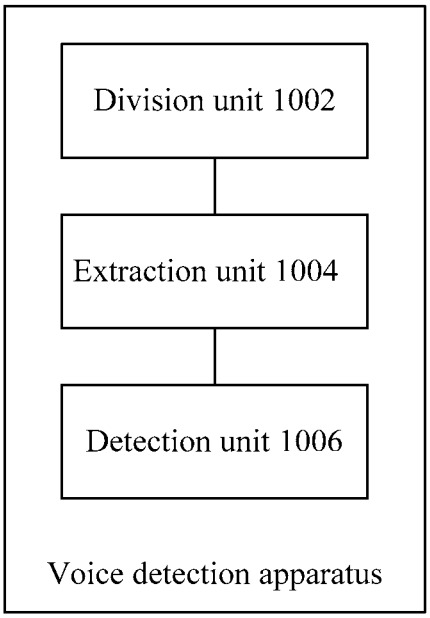
FIG. 10 is a schematic diagram of an optional voice detection apparatus according to an embodiment of the present disclosure.

According to an embodiment of the present disclosure, a voice detection apparatus used to implement the voice detection method is further provided. As shown in FIG. 10, the apparatus includes:

1) a division unit 1002, configured to divide a to-be-detected audio signal into a plurality of audio segments;

2) an extraction unit 1004, configured to extract an audio characteristic in each of the audio segments, where the audio characteristic includes at least a time domain characteristic and a frequency domain characteristic of the audio segment; and 3) a detection unit 1006, configured to detect a target voice segment from the audio segment according to the audio characteristic of the audio segment.

Optionally, in this embodiment, the voice detection apparatus may be but is not limited to being applied to at least one of the following scenarios: an intelligent robot chat system, an automatic question-answering system, human-computer chat software, or the like. That is, in a process of applying the voice detection apparatus provided in this embodiment to human-computer interaction, an audio characteristic that is in an audio segment and that includes at least characteristics that is of the audio segment and that are in a time domain and a frequency domain is extracted, to accurately detect a target voice segment in a plurality of audio segments into which a to-be-detected audio signal is divided, so that a device used for human-computer interaction can learn a starting moment and an ending moment of a voice segment formed by the target voice segments, and the device accurately reply after obtaining complete voice information that needs to be expressed. Herein, in this embodiment, the voice segment may include but is not limited to: a target voice segment or a plurality of consecutive target voice segments. Each target voice segment includes a starting moment and an ending moment of the target voice segment. This is not limited in this embodiment.

It should be noted that, in this embodiment, by means of a human-computer interaction device, a to-be-detected audio signal is divided into a plurality of audio segments, and an audio characteristic in each of the audio segments is extracted, where the audio characteristic includes at least a time domain characteristic and a frequency domain characteristic of the audio segment, thereby implementing integration of a plurality of characteristics that is of an audio segment and that is in different domains to accurately detect a target voice segment from the plurality of audio segments, so as to reduce interference of a noise signal in the audio segments to a voice detection process, thereby achieving an objective of increasing voice detection accuracy, and resolving a problem in a related technology that detection accuracy is relatively low due to a manner in which voice detection is performed by using only a single characteristic.

Further, when the target voice segment is accurately detected, a human-computer interaction device can further quickly determine, in real time, a starting moment and an ending moment of a voice segment formed by the target voice segments, so that the human-computer interaction device accurately responds, in real time, to voice information obtained by means of detection, and an effect of natural human-computer interaction is achieved. In addition, by accurately detecting the starting moment and the ending moment of the voice segment formed by the target voice segments, the human-computer interaction device further achieves an effect of increasing human-computer interaction efficiency, and resolves a problem in a related technology that the human-computer interaction efficiency is relatively low because an interaction person presses a control button to trigger a human-computer interaction starting process.

Optionally, in this embodiment, the audio characteristic may include but is not limited to at least one of the following: a signal zero-crossing rate in a time domain, short-time energy in a time domain, spectral flatness in a frequency domain, or signal information entropy in a time domain, a self-correlation coefficient, a signal after wavelet transform, signal complexity, or the like.

It should be noted that, 1) the signal zero-crossing rate may be but is not limited to being used to eliminate interference from some impulse noises; 2) the short-time energy may be but is not limited to being used to measure an amplitude value of the audio signal, and eliminate interference from speech voices of an unrelated population With reference to a threshold; 3) the spectral flatness may be but is not limited to being used to calculate, within a frequency domain, a signal frequency distribution feature, and determine whether the audio signal is a background white Gaussian noise according to a value of the characteristic; 4) the signal information entropy in the time domain may be but is not limited to being used to measure an audio signal distribution feature in the time domain, and the characteristic is used to distinguish a voice signal from a common noise. In this embodiment, the plurality of characteristics in the time domain and the frequency domain are integrated into a voice detection process to resist interference from an impulse noise or a background noise, and enhance robustness, so as to accurately detect a target voice segment from a plurality of audio segments into which a to-be-detected audio signal is divided, and accurately obtain a starting moment and an ending moment of a voice segment formed by the target voice segment, to implement natural human-computer interaction.

Optionally, in this embodiment, a manner of detecting a target voice segment from a plurality of audio segments in an audio signal according to an audio characteristic of an audio segment may include but is not limited to: determining whether the audio characteristic of the audio segment satisfies a predetermined threshold condition; when the audio characteristic of the audio segment satisfies the predetermined threshold condition, detecting that the audio segment is the target voice segment.

It should be noted that, in this embodiment, when whether the audio characteristic of the audio segment satisfies the predetermined threshold condition is determined, a current audio segment used for the determining may be obtained from the plurality of audio segments according to at least one of the following sequences: 1) according to an input sequence of the audio signal; 2) according to a predetermined sequence. The predetermined sequence may be a random sequence, or may be a sequence arranged according to a predetermined rule, for example, according to a sequence of sizes of the audio segments. The foregoing is only an example, and this is not limited in this embodiment.

In addition, in this embodiment, the predetermined threshold condition may be but is not limited to performing adaptive update and adjustment according to varying scenarios. The predetermined threshold condition used to compare with the audio characteristic is constantly updated, to ensure that the target voice segment is accurately detected from the plurality of audio segments in a detection process according to different scenarios. Further, for a plurality of characteristics that is of an audio segment and that is in a plurality of domains, whether corresponding predetermined threshold conditions are satisfied is separately determined, to perform determining and screening on the audio segment for a plurality of times, thereby ensuring that a target voice segment is accurately detected.

Optionally, in this embodiment, when an audio segment is obtained from a plurality of audio segments according to an input sequence of an audio signal, to determine whether an audio characteristic of the audio segment satisfies a predetermined threshold condition, the detecting a target voice segment from the audio segment according to the audio characteristic of the audio segment includes: repeatedly performing the following steps, until a current audio segment is a last audio segment in the plurality of audio segments, where the current audio segment is initialized as a first audio segment in the plurality of audio segments:

S1: Determine whether an audio characteristic of the current audio segment satisfies a predetermined threshold condition.

S2: When the audio characteristic of the current audio segment satisfies the predetermined threshold condition, detect that the current audio segment is the target voice segment.

S3: When the audio characteristic of the current audio segment does not satisfy the predetermined threshold condition, update the predetermined threshold condition according to at least the audio characteristic of the current audio segment, to obtain the updated predetermined threshold condition.

S4: Determine whether the current audio segment is the last audio segment in the plurality of audio segments, and if the current audio segment is not the last audio segment, use a next audio segment of the current audio segment as the current audio segment.

It should be noted that, in this embodiment, the predetermined threshold condition may be but is not limited to being updated according to at least an audio characteristic of a current audio segment, to obtain an updated predetermined threshold condition. That is, when the predetermined threshold condition is updated, a predetermined threshold condition needed by a next audio segment is determined according to an audio characteristic of a current audio segment (a historical audio segment), so that an audio segment detection process is more accurate.

Optionally, in this embodiment, the apparatus further includes:

1) a first obtaining unit, configured to: after the to-be-detected audio signal is divided into the plurality of audio segments, obtain first N audio segments in the plurality of audio segments, where N is an integer greater than 1;

2) a construction unit, configured to construct a noise suppression model according to the first N audio segments, where the noise suppression model is used to perform noise suppression processing on an $N+1^{th}$ audio segment and an audio segment thereafter in the plurality of audio segments; and 3) a second obtaining unit, configured to obtain an initial predetermined threshold condition according to the first N audio segments.

It should be noted that, to ensure accuracy of the voice detection process, in this embodiment, noise suppression processing is performed on the plurality of audio segments, to prevent interference of a noise to a voice signal. For example, a background noise of an audio signal is eliminated in a manner of minimum mean-square error logarithm spectral amplitude estimation.

Optionally, in this embodiment, the first N audio segments may be but are not limited to audio segments without voice input. That is, before a human-computer interaction process is started, an initialization operation is performed, a noise suppression model is constructed by using the audio segments without voice input, and an initial predetermined threshold condition used to determine an audio characteristic. The initial predetermined threshold condition may be but is not limited to being determined according to an average value of audio characteristics of the first N audio segments.

Optionally, in this embodiment, before the extracting an audio characteristic in each of the audio segments, the method further includes: performing second quantization on the collected audio signal, where a quantization level of the second quantization is less than a quantization level of the first quantization.

It should be noted that, in this embodiment, the first quantization may be but is not limited to being performed when the audio signal is collected; and the second quantization may be but is not limited to being performed after the noise suppression processing is performed. In addition, in this embodiment, a higher quantization level indicates more sensitive interference; that is, when a quantization level is relatively large, a quantization interval is relatively small, and therefore a quantization operation is performed on a relatively small noise signal; in this way, a result after the quantization not only includes a voice signal, but also includes a noise signal, and very large interference is caused to voice signal detection. In this embodiment, quantization is implemented twice by adjusting quantization levels, that is, the quantization level of the second quantization is less than the quantization level of the first quantization, thereby filtering a noise signal twice, to reduce interference.

Optionally, in this embodiment, the dividing a to-be-detected audio signal into a plurality of audio segments may include but is not limited to: collecting the audio signal by using a sampling device with a fixed-length window. In this embodiment, a length of the fixed-length window is relatively small. For example, a length of a used window is 256 (signal quantity). That is, the audio signal is divided by using a small window, so as to return a processing result in real time, to complete real-time detection of a voice signal.

According to this embodiment provided by this application, a to-be-detected audio signal is divided into a plurality of audio segments, and an audio characteristic in each of the audio segments is extracted, where the audio characteristic includes at least a time domain characteristic and a frequency domain characteristic of the audio segment, thereby implementing integration of a plurality of characteristics that is of an audio segment and that is in different domains to accurately detect a target voice segment from the plurality of audio segments, so as to reduce interference of a noise signal in the audio segments to a voice detection process, thereby achieving an objective of increasing voice detection accuracy, and resolving a problem in a related technology that detection accuracy is relatively low due to a manner in which voice detection is performed by using only a single characteristic.

As an optional solution, the detection unit 1006 includes:

1) a judgment module, configured to determine whether the audio characteristic of the current audio segment satisfies a predetermined threshold condition, where the audio characteristic of the audio segment includes: a signal zero-crossing rate of the current audio segment in a time domain, short-time energy of the current audio segment in a time domain, spectral flatness of the current audio segment in a frequency domain, or signal information entropy of the current audio segment in a time domain; and 2) a detection module, configured to: when the audio characteristic of the current audio segment satisfies the predetermined threshold condition, detect that the current audio segment is the target voice segment.

Optionally, in this embodiment, an audio characteristic of a current audio segment x (i) in N audio segments may be obtained by using the following formulas:

1) Calculate a signal zero-crossing rate (that is, a short-time zero-crossing rate) in a time domain:

$$Z_n = \frac{1}{2N}\sum_{i=0}^{N-1}|sgn(x(i)) - sgn(x(i-1))| \tag{1}$$

where sgn[ ] is a symbol function:

$$sgn[x] = \begin{cases} 1 & x \geq 0 \\ -1 & x < 0 \end{cases} \tag{2}$$

2) Calculate short-time energy in a time domain:

$$E_n = \Sigma_{i=0}^{N-1} x^2(i)h(N-i) \tag{3}$$

where h[i] is a window function, and the following function can be used:

$$h[i] = \begin{cases} 1/N & 0 \leq i \leq N-1 \\ 0 & i \text{ is another value} \end{cases} \tag{4}$$

3) Calculate spectral flatness in a frequency domain:

First, Fourier transformation is performed on the audio segment x(i) i=0, 1, 2 . . . , N−1 to obtain an amplitude value f(i) i=0, 1, 2 . . . , N−10, 1, 2 . . . , N−1 in the frequency domain.

The spectral flatness is calculated according to the following formula:

$$F_n = \frac{\sqrt[n]{\prod_{i=0}^{n-1} f(i)}}{\frac{\sum_{i=0}^{n-1} f(i)}{n}} = \frac{\exp\left(\frac{1}{N}\sum_{i=0}^{N-1} lnf(i)\right)}{\frac{1}{N}\sum_{i=0}^{N-1} f(i)} \tag{5}$$

4) Calculate signal information entropy in a time domain:

First, a value of a relative probability after a signal absolute value is normalized is calculated:

$$p(i) = \frac{|x(i)|}{\sum_{i=0}^{N-1} |x(i)|} \tag{6}$$

The signal information entropy is then calculated according to the following formula:

$$I_n = \Sigma_{i=0}^{N-1} p(i)\log_2 p(i) \tag{7}$$

Specifically, a description is provided with reference to the following example. FIG. 4 shows original audio signals with impulse noises. There are some impulse noises in an intermediate section (signals within a range of 50000 to 150000 on the horizontal axis), and voice signals are in a last section (signals within a range of 230000 to 240000 on the horizontal axis). FIG. 5 shows audio signals for which signal zero-crossing rates are separately extracted from original audio signals. It can be seen that, an impulse noise can be well distinguished according to a characteristic of the signal zero-crossing rate. For example, impulse noises in an intermediate section (signals within a range of 50000 to 150000 on the horizontal axis) can be directly filtered out; however, low-energy non-impulse noises (signals within a range of 210000 to 220000 on the horizontal axis) cannot be distinguished. FIG. 6 shows audio signals for which short-time energy is separately extracted from original audio signals. It can be seen that, by using a characteristic of the short-time energy, low-energy non-impulse noises (signals within a range of 210000 to 220000 on the horizontal axis) can be filtered out; however, impulse noises (impulse signals also have relatively large energy) in an intermediate section (signals within a range of 50000 to 150000 on the horizontal axis) cannot be distinguished. FIG. 7 shows audio signals for which spectral flatness and signal information entropy are extracted from original audio signals. By using the two, both voice signals and impulse noises can be detected, and all voice like signals can be reserved to the greatest extent. Further, in addition, FIG. 8 shows a manner provided in this embodiment: based on the extraction of the spectral flatness and the signal information entropy, the short-time energy, the foregoing four characteristics, and the characteristic of the signal zero-crossing rate are extracted for audio signals, so that interference from an impulse noise and another low-energy noise can be distinguished, and an actual voice signal can be detected. It can be known from the signals shown in the foregoing figures that, an audio signal extracted in this embodiment is more beneficial to accurate detection of a target voice segment.

According to this embodiment provided by this application, the plurality of characteristics in the time domain and the frequency domain are integrated into a voice detection process to resist interference from an impulse noise or a background noise, and enhance robustness, so as to accurately detect a target voice segment from a plurality of audio segments into which a to-be-detected audio signal is divided, and accurately obtain a starting moment and an ending moment of a voice signal corresponding to the target voice segment, to implement natural human-computer interaction.

As an optional solution, the detection unit 1006 includes:

1) The judgment module is configured to repeatedly perform the following steps, until a current audio segment is a last audio segment in the plurality of audio segments, where the current audio segment is initialized as a first audio segment in the plurality of audio segments:

S1: Determine whether an audio characteristic of the current audio segment satisfies a predetermined threshold condition.

S2: When the audio characteristic of the current audio segment satisfies the predetermined threshold condition, detect that the current audio segment is the target voice segment.

S3: When the audio characteristic of the current audio segment does not satisfy the predetermined threshold condition, update the predetermined threshold condition according to at least the audio characteristic of the current audio segment, to obtain the updated predetermined threshold condition.

S4: Determine whether the current audio segment is the last audio segment in the plurality of audio segments, and if the current audio segment is not the last audio segment, use a next audio segment of the current audio segment as the current audio segment.

Optionally, in this embodiment, the predetermined threshold condition may be but is not limited to performing adaptive update and adjustment according to varying scenarios. In this embodiment, when an audio segment is obtained from a plurality of audio segments according to an input sequence of an audio signal, to determine whether an audio characteristic of the audio segment satisfies a predetermined threshold condition, the predetermined threshold condition may be but is not limited to being updated according to at least an audio characteristic of a current audio segment. That is, when the predetermined threshold condition needs to be updated, a next updated predetermined threshold condition is obtained based on the current audio segment (a historical audio segment).

It should be noted that, for a to-be-detected audio signal, there are a plurality of audio segments, and the foregoing determining process is repeatedly performed for each audio segment, until the plurality of audio segments to which the to-be-detected audio signal is divided is traversed, that is, until the current audio segment is a last audio segment in the plurality of audio segments.

According to this embodiment provided by this application, the predetermined threshold condition used to compare with the audio characteristic is constantly updated, to ensure that the target voice segment is accurately detected from the plurality of audio segments in a detection process according to different scenarios. Further, for a plurality of characteristics that is of an audio segment and that is in a plurality of domains, whether corresponding predetermined threshold conditions are satisfied is separately determined, to perform determining and screening on the audio segment for a plurality of times, thereby ensuring that an accurate target voice segment is detected.

As an optional solution:

1) The judgment module includes: (1) a judgment submodule, configured to: determine whether the signal zero-crossing rate of the current audio segment in a time domain is greater than a first threshold; when the signal zero-crossing rate of the current audio segment is greater than the first threshold, determine whether the short-time energy of the current audio segment in the time domain is greater than a second threshold; when the short-time energy of the current audio segment is greater than the second threshold, determine whether the spectral flatness of the current audio segment in the frequency domain is less than a third threshold; and when the spectral flatness of the current audio segment in the frequency domain is less than the third threshold, determine whether the signal information entropy of the current audio segment in the time domain is less than a fourth threshold.

2) The detection module includes: (1) a detection submodule, configured to: when determining that the signal information entropy of the current audio segment is less than the fourth threshold, detect that the current audio segment is the target voice segment.

Optionally, in this embodiment, the process of detecting a target voice segment according to a plurality of characteristics that is of a current audio segment and that is in a time domain and a frequency domain may be but is not limited to being performed after second quantization is performed on an audio signal. This is not limited in this embodiment.

It should be noted that, the audio characteristic has the following functions in a voice detection process:

1) signal zero-crossing rate: obtaining a signal zero-crossing rate that is of a current audio segment and that is in a time domain, where the signal zero-crossing rate indicates a quantity of times that a waveform of an audio signal crosses the zero axis, and generally, a zero-crossing rate of a voice signal is greater than a zero-crossing rate of a non-voice signal;

2) short-time energy: obtaining time domain energy that is of a current audio segment and that is in time domain amplitude, where a signal with the short-time energy is used to distinguish a non-voice signal from a voice signal in terms of signal energy, and generally, short-time energy of the voice signal is greater than short-time energy of the non-voice signal;

3) spectral flatness: performing Fourier transformation on a current audio segment and calculating spectral flatness thereof, where frequency distribution of a voice signal is relatively concentrative, and corresponding spectral flatness is relatively small; and frequency distribution of a white Gaussian noise signal is relatively dispersive, and corresponding spectral flatness is relatively large; and 4) signal information entropy: normalizing a current audio segment and then calculating signal information entropy, where distribution of a voice signal is relatively concentrative, and corresponding signal information entropy is small; and distribution of a non-voice signal, in particular, a white Gaussian noise is relatively dispersive, and corresponding signal information entropy is relatively large.

Specifically, a description is provided with reference to the example shown in FIG. 9:

S902: Obtain an audio characteristic of a current audio segment.

S904: Determine whether a signal zero-crossing rate of the current audio segment is greater than a first threshold, and if the signal zero-crossing rate of the current audio segment is greater than the first threshold, perform a next operation; or if the signal zero-crossing rate of the current audio segment is less than or equal to the first threshold, directly determine the current audio segment as a non-target voice segment.

S906: Determine whether short-time energy of the current audio segment is greater than a second threshold, and if the short-time energy of the current audio segment is greater than the second threshold, perform a next step of determining; or if the short-time energy of the current audio segment is less than or equal to the second threshold, directly determine the current audio segment as a non-target voice segment, and update the second threshold according to the short-time energy of the current audio segment.

S908: Determine whether spectral flatness of the current audio segment is less than a third threshold, and if the spectral flatness of the current audio segment is less than the third threshold, perform a next step of determining; or if the spectral flatness of the current audio segment is greater than or equal to the third threshold, directly determine the current audio segment as a non-target voice segment, and update the third threshold according to the spectral flatness of the current audio segment.

S910: Determine whether signal information entropy of the current audio segment is less than a fourth threshold, and if the signal information entropy of the current audio segment is less than the fourth threshold, perform a next step of determining; or if the signal information entropy of the current audio segment is greater than or equal to the fourth threshold, directly determine the current audio segment as a non-target voice segment, and update the fourth threshold according to the spectral flatness of the current audio segment.

After step S910 is complete, when it is determined that all of the four characteristics satisfy the corresponding predetermined threshold conditions, the current audio segment is determined as the target voice segment.

According to this embodiment provided by this application, by integrating a plurality of characteristics that is of an audio segment and that is in different domains, a target voice segment is accurately detected from the plurality of audio segments, to reduce interference of a noise signal in the audio segment to a voice detection process, achieving an objective of increasing voice detection accuracy.

As an optional solution, the judgment module implements the updating the predetermined threshold condition according to at least the audio characteristic of the current audio segment, by performing the following steps, including:

1) when the short-time energy of the current audio segment is less than or equal to the second threshold, updating the second threshold according to at least the short-time energy of the current audio segment; or 2) when the spectral flatness of the current audio segment is greater than or equal to the third threshold, updating the third threshold according to at least the spectral flatness of the current audio segment; or 3) when the signal information entropy of the current audio segment is greater than or equal to the fourth threshold, updating the fourth threshold according to at least the signal information entropy of the current audio segment.

Optionally, in this embodiment, the judgment module implements the updating the predetermined threshold condition according to at least the audio characteristic of the current audio segment, by performing the following steps, including:

$$A=a\times A'+(1-a)\times B \quad (8)$$

where, a indicates an attenuation coefficient, and when B indicates the short-time energy of the current audio segment, A' indicates the second threshold, and A indicates the updated second threshold; when B indicates the spectral flatness of the current audio segment, A' indicates the third threshold, and A indicates the updated third threshold; or when B indicates the signal information entropy of the current audio segment, A' indicates the fourth threshold, and A indicates the updated fourth threshold.

That is, when the predetermined threshold condition is updated, a predetermined threshold condition needed by a next audio segment is determined according to an audio characteristic of a current audio segment (a historical audio segment), so that a target voice detection process is more accurate.

According to this embodiment provided by this application, the predetermined threshold condition used to compare with the audio characteristic is constantly updated, to ensure that the target voice segment is accurately detected from the plurality of audio segments in a detection process according to different scenarios.

As an optional solution, the apparatus further includes:

1) a determining unit, configured to: after the target voice segment is detected from the audio segment according to the audio characteristic of the audio segment, determine, according to a location that is of the target voice segment and that is in the plurality of audio segments, a starting moment and an ending moment of a continuous voice segment formed by the target voice segment.

Optionally, in this embodiment, the voice segment may include but is not limited to: a target voice segment or a plurality of consecutive target voice segments. Each target voice segment includes a starting moment of the target voice segment and an ending moment of the target voice segment.

It should be noted that, in this embodiment, when the target voice segment is detected from the plurality of audio segments, a starting moment and an ending moment of a voice segment formed by the target voice segment may be obtained according to a time label of the target voice segment, for example, the starting moment of the target voice segment and the ending moment of the target voice segment.

Optionally, in this embodiment, the determining unit includes:

1) a first obtaining module, configured to: obtain a starting moment of a first target voice segment in K consecutive target voice segments, and use the starting moment of the first target voice segment as the starting moment of the continuous voice segment; and 2) a second obtaining module, configured to: after the starting moment of the continuous voice segment is confirmed, obtain a starting moment of a first non-target voice segment in M consecutive non-target voice segments after a $K^{th}$ target voice segment, and use the starting moment of the first non-target voice segment as the ending moment of the continuous voice segment.

Optionally, in this embodiment, K is an integer greater than or equal to 1, and M may be set to different values according to different scenarios. This is not limited in this embodiment.

Specifically, a description is provided with reference to the following example. It is assumed that, target voice segments detected from a plurality of (for example, 20) audio segments (it is assumed that each duration is T) include P1 to P5, P7 to P8, P10, and P17 to P20. Further, it is assumed that M is 5.

It can be known based on the foregoing assumptions that, the first five target voice segments are consecutive, there is a non-target voice segment (that is, P6) between P5 and P7, there is a non-target voice segment (that is, P9) between P8 and P10, and there are six non-target voice segments (that is, P11 to P16) between P10 and P17.

It can be confirmed according to first K (that is, first five) consecutive target voice segments that: a voice segment A including a voice signal is detected from a to-be-detected audio signal, where a starting moment of the voice segment A is a starting moment (that is, a starting moment of P1) of a first target voice segment in the first five target voice segments. Further, a quantity of non-target voice segments between P5 and P7 is 1, that is, less than M (M=5), and a quantity of non-target voice segments between P8 and P10 is 1, that is, less than M (M=5). Therefore, it can be determined that, the foregoing voice segment A is not ended at the non-target voice segment P6 and the non-target voice segment P9. A quantity of non-target voice segments between P10 and P17 is 6, that is, greater than M (M=5), that is, a quantity of consecutive non-target voice segments (P11 to P16) already satisfies M preset thresholds. Therefore, it can be determined that the voice segment A is ended at a starting moment (that is, a starting moment of P11) of a first non-target voice segment in the consecutive non-target voice segments (that is, P11 to P16), and then the starting moment of P11 is used as an ending moment of the voice segment A. That is, the starting moment of the voice segment A is a starting moment 0 of P1, and the ending moment is a starting moment 10 T of P11.

Herein, it should be noted that, in this example, the foregoing consecutive target voice segments P17 to P20 are used to determine a detection process of a next voice segment B. The detection process may be performed by referring to the foregoing process, and details are not described herein again in this embodiment.

In addition, in this embodiment, a to-be-detected audio signal may be but is not limited to being obtained in real time, so as to detect whether an audio segment in an audio signal is a target voice segment, thereby accurately detecting a starting moment of a voice segment formed by the target voice segment and an ending moment of the voice segment, and implementing that a human-computer interaction device can accurately reply after obtaining complete voice information that needs to be expressed by the voice segment, to implement human-computer interaction. It should be noted that, in a process of obtaining the to-be-detected audio signal in real time, voice detection may be but is not limited to repeatedly performing the foregoing detection steps. In this embodiment, details are not described herein again.

According to this embodiment provided by this application, when the target voice segment is accurately detected, a human-computer interaction device can further quickly determine, in real time, a starting moment and an ending moment of a voice segment formed by the target voice segment, so that the human-computer interaction device accurately responds to obtained voice information in real time, and an effect of natural human-computer interaction is achieved. In addition, by accurately detecting the starting moment and the ending moment of the voice signal corresponding to the target voice segment, the human-computer interaction device further achieves an effect of increasing human-computer interaction efficiency, and resolves a problem in a related technology that the human-computer interaction efficiency is relatively low because an interaction person presses a control button to trigger a human-computer interaction starting process.

As an optional solution, the apparatus further includes:

1) a first obtaining unit, configured to: after the to-be-detected audio signal is divided into the plurality of audio segments, obtain first N audio segments in the plurality of audio segments, where N is an integer greater than 1;

2) a construction unit, configured to construct a noise suppression model according to the first N audio segments, where the noise suppression model is used to perform noise suppression processing on an $N+1^{th}$ audio segment and an audio segment thereafter in the plurality of audio segments; and 3) a second obtaining unit, configured to obtain an initial predetermined threshold condition according to the first N audio segments.

For example, specifically, a noise suppression model is constructed according to first N audio segments in the following manner. It is assumed that an audio signal includes a pure voice signal and an independent white Gaussian noise. Then, noise suppression may be performed in the following manner: Fourier transformation is performed on background noises of the first N audio segments, to obtain signal frequency domain information; a frequency domain logarithm spectral characteristic of the noises is estimated according to the frequency domain information of the Fourier transformation, to construct the noise suppression model. Further, for an $N+1^{th}$ audio segment and an audio segment thereafter, it may be but is not limited to performing noise elimination processing on audio signals based on the noise suppression model and by using a maximum likelihood estimation method.

For another example, before a human-computer interaction process is started, an initialization operation is performed, a noise suppression model is constructed by using the audio segments without voice input, and an initial predetermined threshold condition used to determine an audio characteristic. The initial predetermined threshold condition may be but is not limited to being determined according to an average value of audio characteristics of the first N audio segments.

According to this embodiment provided by this application, an initialization operation of human-computer interaction is implemented by using first N audio segments in a plurality of audio segments. For example, a noise suppression model is constructed, to perform noise suppression processing on the plurality of audio segments, preventing interference of a noise to a voice signal. For example, an initial predetermined threshold condition used to determine an audio characteristic is obtained, so as to perform voice detection on the plurality of audio segments.

As an optional solution, the apparatus further includes:

1) a collection unit, configured to: before the audio characteristic in each of the audio segments is extracted, collect the to-be-detected audio signal, where first quantization is performed on the audio signal when the audio signal is collected; and 2) a quantization unit, configured to perform second quantization on the collected audio signal, where a quantization level of the second quantization is less than a quantization level of the first quantization.

It should be noted that, in this embodiment, the first quantization may be but is not limited to being performed when the audio signal is collected; and the second quantization may be but is not limited to being performed after the noise suppression processing is performed. In addition, in this embodiment, a higher quantization level indicates more sensitive interference; that is, smaller interference indicates easier interference to a voice signal, and interference is implemented twice by adjusting quantization levels, to achieve an effect of filtering out the interference twice.

Specifically, a description is provided with reference to the following example. For example, during first quantization, 16 bits are used, and during second quantization, 8 bits are used, that is, a range of [−128-127], thereby accurately distinguishing a voice signal from a noise by means of filtering for a second time.

Embodiment 3

Figure 11:
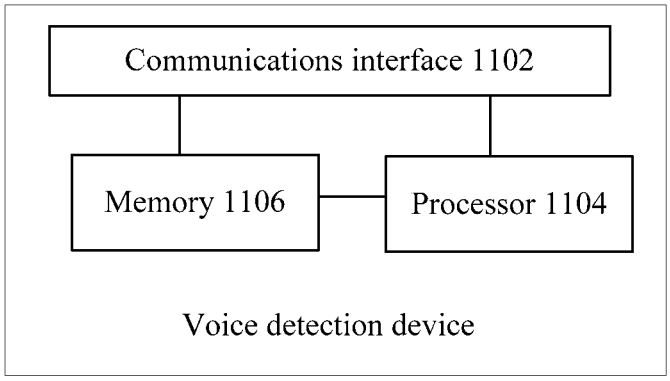
FIG. 11 is a schematic diagram of an optional voice detection device according to an embodiment of the present disclosure.

According to an embodiment of the present disclosure, a voice detection device used to implement the voice detection method is further provided. As shown in FIG. 11, the device includes:

1) a communications interface 1102, configured to obtain a to-be-detected audio signal;

2) processing circuitry such as a processor 1104, connected to the communications interface 1102, and configured to divide the to-be-detected audio signal into a plurality of audio segments; further configured to extract an audio characteristic in each of the audio segments, where the audio characteristic includes at least a time domain characteristic and a frequency domain characteristic of the audio segment; and further configured to detect a target voice segment from the audio segment according to the audio characteristic of the audio segment; and 3) a memory 1106, connected to the communications interface 1102 and the processor 1104, and configured to store the plurality of audio segments and the target voice segment in the audio signal.

Optionally, for a specific example in this embodiment, refer to the examples described in Embodiment 1 and Embodiment 2, and details are not described herein again in this embodiment.

Embodiment 4

An embodiment of the present disclosure further provides a storage medium. Optionally, in this embodiment, the storage medium is configured to store program code used to perform the following steps:

S1: Divide a to-be-detected audio signal into a plurality of audio segments.

S2: Extract an audio characteristic in each of the audio segments, where the audio characteristic includes at least a time domain characteristic and a frequency domain characteristic of the audio segment.

S3: Detect a target voice segment from the audio segment according to the audio characteristic of the audio segment.

Optionally, in this embodiment, the storage medium is further configured to store program code used to perform the following steps: determining whether the audio characteristic of the current audio segment satisfies a predetermined threshold condition, where the audio characteristic of the audio segment includes: a signal zero-crossing rate of the current audio segment in a time domain, short-time energy of the current audio segment in a time domain, spectral flatness of the current audio segment in a frequency domain, or signal information entropy of the current audio segment in a time domain; and when the audio characteristic of the current audio segment satisfies the predetermined threshold condition, detecting that the current audio segment is the target voice segment.

Optionally, in this embodiment, storage medium the storage medium is further configured to store program code used to perform the following steps: the detecting a target voice segment from the audio segment according to the audio characteristic of the audio segment includes: repeatedly performing the following steps, until a current audio segment is a last audio segment in the plurality of audio segments, where the current audio segment is initialized as a first audio segment in the plurality of audio segments: determining whether an audio characteristic of the current audio segment satisfies a predetermined threshold condition; when the audio characteristic of the current audio segment satisfies the predetermined threshold condition, detecting that the current audio segment is the target voice segment; or when the audio characteristic of the current audio segment does not satisfy the predetermined threshold condition, updating the predetermined threshold condition according to at least the audio characteristic of the current audio segment, to obtain the updated predetermined threshold condition; and determining whether the current audio segment is the last audio segment in the plurality of audio segments, and if the current audio segment is not the last audio segment, using a next audio segment of the current audio segment as the current audio segment.

Optionally, in this embodiment, the storage medium is further configured to store program code used to perform the following steps: the determining whether an audio characteristic of the current audio segment satisfies a predetermined threshold condition includes: determining whether the signal zero-crossing rate of the current audio segment in a time domain is greater than a first threshold; when the signal zero-crossing rate of the current audio segment is greater than the first threshold, determining whether the short-time energy of the current audio segment in the time domain is greater than a second threshold; when the short-time energy of the current audio segment is greater than the second threshold, determining whether the spectral flatness of the current audio segment in the frequency domain is less than a third threshold; and when the spectral flatness of the current audio segment in the frequency domain is less than the third threshold, determining whether the signal information entropy of the current audio segment in the time domain is less than a fourth threshold; and the when the audio characteristic of the current audio segment satisfies the predetermined threshold condition, detecting that the current audio segment is the target voice segment includes: when determining that the signal information entropy of the current audio segment is less than the fourth threshold, detecting that the current audio segment is the target voice segment.

Optionally, in this embodiment, the storage medium is further configured to store program code used to perform the following step: when the short-time energy of the current audio segment is less than or equal to the second threshold, updating the second threshold according to at least the short-time energy of the current audio segment; or when the spectral flatness of the current audio segment is greater than or equal to the third threshold, updating the third threshold according to at least the spectral flatness of the current audio segment; or when the signal information entropy of the current audio segment is greater than or equal to the fourth threshold, updating the fourth threshold according to at least the signal information entropy of the current audio segment.

Optionally, in this embodiment, the storage medium is further configured to store program code used to perform the following step:

$$A=a\times A'+(1-a)\times B,$$

where, a indicates an attenuation coefficient, and when B indicates the short-time energy of the current audio segment, A' indicates the second threshold, and A indicates the updated second threshold; when B indicates the spectral flatness of the current audio segment, A' indicates the third threshold, and A indicates the updated third threshold; or when B indicates the signal information entropy of the current audio segment, A' indicates the fourth threshold, and A indicates the updated fourth threshold.

Optionally, in this embodiment, the storage medium is further configured to store program code used to performing the following step: after the target voice segment is detected from the audio segment according to the audio characteristic of the audio segment, determining, according to a location that is of the target voice segment and that is in the plurality of audio segments, a starting moment and an ending moment of a continuous voice segment formed by the target voice segment.

Optionally, in this embodiment, the storage medium is further configured to store program code used to perform the following steps: obtaining a starting moment of a first target voice segment in K consecutive target voice segments, and using the starting moment of the first target voice segment as the starting moment of the continuous voice segment; and after the starting moment of the continuous voice segment is confirmed, obtaining a starting moment of a first non-target voice segment in M consecutive non-target voice segments after a $K^{th}$ target voice segment, and using the starting moment of the first non-target voice segment as the ending moment of the continuous voice segment.

Optionally, in this embodiment, the storage medium is further configured to store program code used to perform the following steps: after the dividing a to-be-detected audio signal into a plurality of audio segments, obtaining first N audio segments in the plurality of audio segments, where N is an integer greater than 1; constructing a noise suppression model according to the first N audio segments, where the noise suppression model is used to perform noise suppression processing on an $N+1^{th}$ audio segment and an audio segment thereafter in the plurality of audio segments; and obtaining an initial predetermined threshold condition according to the first N audio segments.

Optionally, in this embodiment, the storage medium is further configured to store program code used to perform the following steps: before the extracting an audio characteristic in each of the audio segments, collecting the to-be-detected audio signal, where first quantization is performed on the audio signal when the audio signal is collected; and performing second quantization on the collected audio signal, where a quantization level of the second quantization is less than a quantization level of the first quantization.

Optionally, in this embodiment, the storage medium is further configured to store program code used to perform the following step: before the performing second quantization on the collected audio signal, performing noise suppression processing on the collected audio signal.

Optionally, in this embodiment, the storage medium may include but is not limited to various transitory or non-transitory mediums that can store program code, for example, a USB disk, a read-only memory (ROM), a random access memory (RAM), a mobile disk, a magnetic disk, and an optical disc.

Optionally, for a specific example in this embodiment, refer to the examples described in Embodiment 1 and Embodiment 2, and details are not described herein again in this embodiment.

The sequence numbers of the preceding embodiments of the present disclosure are merely for description purpose but do not indicate the preference of the embodiments.

When being implemented in a form of software functional unit and sold or used as independent products, the integrated units in the foregoing embodiments may be stored the foregoing computer-readable storage medium. Based on such understanding, a technical solution of the present disclosure essentially or a portion that is of the technical solution of the present disclosure and that has contributions to the related technology or all of or a portion of the technical solution may be embodied in a software product form. The computer software product is stored in a storage medium, and includes several instructions used to make one or more computer devices (which may be a personal computer, a server, and a network device) perform all or some steps of the method in the embodiments of the present disclosure.

In the embodiments of the present disclosure, the descriptions about the embodiments have respective emphases. For a portion that is not described in an embodiment, refer to a related description in another embodiment.

In the several embodiments provided in the present application, it should be understood that the disclosed client may be implemented in other manners. The apparatus embodiments described in the foregoing are merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the units or modules may be implemented in electronic or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of this application may be integrated into one processing unit, or each of the units may exist alone physically, or two or more units are integrated into one unit. The integrated unit may be implemented in a form of hardware, or may be implemented in a form of a software functional unit.

Described in the foregoing are only exemplary implementations of the present disclosure. It should be pointed out that, the person of ordinary skill in the art may further make several improvements and modifications without disobeying the principle of the present disclosure. These improvements and modifications should also fall within the protection scope of the present disclosure.

INDUSTRIAL PRACTICABILITY

In the embodiments of the present disclosure, a to-be-detected audio signal is divided into a plurality of audio segments, and an audio characteristic in each of the audio segments is extracted, where the audio characteristic includes at least a time domain characteristic and a frequency domain characteristic of the audio segment, thereby implementing integration of a plurality of characteristics that is of an audio segment and that is in different domains to accurately detect a target voice segment from the plurality of audio segments, so as to reduce interference of a noise signal in the audio segments to a voice detection process, thereby achieving an objective of increasing voice detection accuracy, and resolving a problem in a related technology that detection accuracy is relatively low due to a manner in which voice detection is performed by using only a single characteristic.

What is claimed is:

1. A voice detection method, comprising:

dividing, by processing circuitry of an information processing apparatus, an audio signal into a plurality of audio segments;

extracting audio characteristics from each of the plurality of audio segments, the audio characteristics of the respective audio segment including a time domain characteristic and a frequency domain characteristic of the respective audio segment;

detecting, by the processing circuitry of the information processing apparatus, a starting moment of at least one target voice segment from the plurality of audio segments according to the audio characteristics of the plurality of audio segments, the at least one target voice segment corresponding to speech of a person, the starting moment of the at least one target voice segment obtained in K consecutive target voice segments of the at least one target voice segment; and detecting an ending moment of the at least one target voice segment based on a set of consecutive segments from the plurality of audio segments that (i) are not associated with the at least one target voice segment and (ii) have a length that exceeds a non-target threshold M, wherein a starting moment of a non-target voice segment is obtained in M consecutive non-target voice segments in the plurality of audio segments after $K^{th}$ target voice segment, the non-target voice segment corresponding to speech output from an electronic device, and wherein the starting moment of the non-target voice segment is used as the ending moment of the at least one target voice segment.

2. The method according to claim 1, wherein the detecting the at least one target voice segment from the plurality of audio segments according to the audio characteristics of the plurality of audio segments comprises:

determining whether one of the audio characteristics of one of the plurality of audio segments satisfies a predetermined threshold condition, wherein the one of the audio characteristics of the one of the audio segments is a signal zero-crossing rate of the one of the audio segments in a time domain, short-time energy of the one of the audio segments in the time domain, spectral flatness of the one of the audio segments in a frequency domain, or signal information entropy of the one of the plurality of audio segments in the time domain; and when the one of the audio characteristics of the one of the audio segments satisfies the predetermined threshold condition, determining that the one of the audio segments is one of the at least one target voice segment.

3. The method according to claim 1, wherein the detecting the at least one target voice segment from the plurality of audio segments according to the audio characteristics of the plurality of audio segments comprises:

when one of the audio characteristics of one of the plurality of audio segments satisfies a predetermined threshold condition, determining that the one of the plurality of audio segments is one of the at least one target voice segment; and when the one of the audio characteristics of the one of the plurality of audio segments does not satisfy the predetermined threshold condition, updating the predetermined threshold condition according to the one of the audio characteristics of the one of the plurality of audio segments, to obtain an updated predetermined threshold condition.

4. The method according to claim 2, wherein the determining whether the one of the audio characteristics of the one of the plurality of audio segments satisfies the predetermined threshold condition comprises:

determining whether the signal zero-crossing rate of the one of the plurality of audio segments in the time domain is greater than a first threshold;

when the signal zero-crossing rate of the one of the plurality of audio segments is greater than the first threshold, determining whether the short-time energy of the one of the plurality of audio segments in the time domain is greater than a second threshold;

when the short-time energy of the one of the plurality of audio segments is greater than the second threshold, determining whether the spectral flatness of the one of the plurality of audio segments in the frequency domain is less than a third threshold;

when the spectral flatness of the one of the plurality of audio segments in the frequency domain is less than the third threshold, determining whether the signal information entropy of the one of the plurality of audio segments in the time domain is less than a fourth threshold; and when the signal information entropy of the one of the plurality of audio segments is less than the fourth threshold, determining that the one of the plurality of audio segments is the one of the at least one target voice segment.

5. The method according to claim 4, further comprising:

when the short-time energy of the one of the plurality of audio segments is less than or equal to the second threshold, updating the second threshold according to at least the short-time energy of the one of the plurality of audio segments;

when the spectral flatness of the one of the plurality of audio segments is greater than or equal to the third threshold, updating the third threshold according to at least the spectral flatness of the one of the plurality of audio segments; and when the signal information entropy of the one of the plurality of audio segments is greater than or equal to the fourth threshold, updating the fourth threshold according to at least the signal information entropy of the one of the plurality of audio segments.

6. The method according to claim 5, further comprising updating the second, third, and fourth thresholds according to:

$$A=a\times A'+(1-a)\times B,$$

wherein, a indicates an attenuation coefficient, and when B indicates the short-time energy of the one of the plurality of audio segments, A' indicates the second threshold, and A indicates an updated second threshold; when B indicates the spectral flatness of the one of the plurality of audio segments, A' indicates the third threshold, and A indicates an updated third threshold; or when B indicates the signal information entropy of the one of the plurality of audio segments, A' indicates the fourth threshold, and A indicates an updated fourth threshold.

7. The method according to claim 1, further comprising:

after the dividing the audio signal into the plurality of audio segments, obtaining first N audio segments in the plurality of audio segments, wherein N is an integer greater than 1;

constructing a noise suppression model according to the first N audio segments, wherein the noise suppression model is used to perform noise suppression processing on one or more of the plurality of audio segments after the first N audio segments in the plurality of audio segments; and obtaining an initial predetermined threshold condition according to the first N audio segments.

8. The method according to claim 1, further comprising:

before the extracting the audio characteristics from each of the audio segments, collecting the audio signal with a first quantization; and performing a second quantization on the collected audio signal, wherein a quantization level of the second quantization is less than a quantization level of the first quantization.

9. The method according to claim 8, further comprising:

before the performing the second quantization on the collected audio signal, performing noise suppression processing on the collected audio signal.

10. The method according to claim 1, wherein the starting moment of the at least one target voice segment is detected based on an adaptive threshold that varies based on the audio characteristics extracted from each of the plurality of audio segments.

11. An information processing apparatus, comprising circuitry configured to:

divide an audio signal into a plurality of audio segments;

extract audio characteristics from each of the plurality of audio segments, the audio characteristics of the respective audio segment including a time domain characteristic and a frequency domain characteristic of the respective audio segment;

detect a starting moment of at least one target voice segment from the plurality of audio segments according to the audio characteristics of the plurality of audio segments, the at least one target voice segment corresponding to speech of a person, the starting moment of the at least one target voice segment obtained in K consecutive target voice segments of the at least one target voice segment; and detect an ending moment of the at least one target voice segment based on a set of consecutive segments from the plurality of audio segments that (i) are not associated with the at least one target voice segment and (ii) have a length that exceeds a non-target threshold M, the at least one target voice segment corresponding to speech output from an electronic device, wherein a starting moment of a non-target voice segment is obtained in M consecutive non-target voice segments in the plurality of audio segments after a $K^{th}$ target voice segment, and wherein the starting moment of the non-target voice segment is used as the ending moment of the at least one target voice segment.

12. The information processing apparatus according to claim 11, wherein the circuitry is further configured to:

determine whether one of the audio characteristics of one of the plurality of audio segments satisfies a predetermined threshold condition, wherein the one of the audio characteristics of the one of the audio segments is a signal zero-crossing rate of the one of the audio segments in a time domain, short-time energy of the one of the audio segments in the time domain, spectral flatness of the one of the audio segments in a frequency domain, or signal information entropy of the one of the audio segments in the time domain; and when the one of the audio characteristics of the one of the audio segments satisfies the predetermined threshold condition, determine that the one of the plurality of audio segments is one of the at least one target voice segment.

13. The information processing apparatus according to claim 10, wherein the circuitry is further configured to:

when one of the audio characteristics of one of the plurality of audio segments satisfies a predetermined threshold condition, determine that the one of the plurality of audio segments is one of the at least one target voice segment; and when the one of the audio characteristics of the one of the plurality of audio segments does not satisfy the predetermined threshold condition, update the predetermined threshold condition according to the one of the audio characteristics of the one of the plurality of audio segments, to obtain an updated predetermined threshold condition.

14. The information processing apparatus according to claim 11, wherein the circuitry is further configured to:

determine whether the signal zero-crossing rate of the one of the plurality of audio segments in the time domain is greater than a first threshold;

when the signal zero-crossing rate of the one of the plurality of audio segments is greater than the first threshold, determine whether the short-time energy of the one of the plurality of audio segments in the time domain is greater than a second threshold;

when the short-time energy of the one of the plurality of audio segments is greater than the second threshold, determine whether the spectral flatness of the one of the plurality of audio segments in the frequency domain is less than a third threshold;

when the spectral flatness of the one of the plurality of audio segments in the frequency domain is less than the third threshold, determine whether the signal information entropy of the one of the plurality of audio segments in the time domain is less than a fourth threshold; and when the signal information entropy of the one of the plurality of audio segments is less than the fourth threshold, determine that the one of the plurality of audio segments is the one of the at least one target voice segment.

15. The information processing apparatus according to claim 14, wherein the circuitry is further configured to:

when the short-time energy of the one of the plurality of audio segments is less than or equal to the second threshold, update the second threshold according to at least the short-time energy of the one of the plurality of audio segments;

when the spectral flatness of the one of the plurality of audio segments is greater than or equal to the third threshold, update the third threshold according to at least the spectral flatness of the one of the plurality of audio segments; and when the signal information entropy of the one of the plurality of audio segments is greater than or equal to the fourth threshold, update the fourth threshold according to at least the signal information entropy of the one of the plurality of audio segments.

16. The information processing apparatus according to claim 15, wherein the circuitry is further configured to:

update the second, third, and fourth thresholds according to:

$$A=a\times A'+(1-a)\times B$$

wherein, a indicates an attenuation coefficient, and when B indicates the short-time energy of the one of the plurality of audio segments, A' indicates the second threshold, and A indicates an updated second threshold; when B indicates the spectral flatness of the one of the plurality of audio segments, A' indicates the third threshold, and A indicates an updated third threshold; or when B indicates the signal information entropy of the one of the plurality of audio segments, A' indicates the fourth threshold, and A indicates an updated fourth threshold.

17. A non-transitory computer-readable medium storing a program executable by a processor to perform:

dividing an audio signal into a plurality of audio segments;

extracting audio characteristics from each of the plurality of audio segments, the audio characteristics of the respective audio segment including a time domain characteristic and a frequency domain characteristic of the respective audio segment;

detecting a starting moment at least one target voice segment from the plurality of audio segments according to the audio characteristics of the plurality of audio segments, the at least one target voice segment corresponding to speech of a person, the starting moment of the at least one target voice segment obtained in K consecutive target voice segments of the at least one detected target voice segment; and detecting an ending moment of the at least one target voice segment based on a set of consecutive segments from the plurality of audio segments that (i) are not associated with the at least one target voice segment and (ii) have a length that exceeds a non-target threshold M, wherein a starting moment of a non-target voice segment is obtained in M consecutive non-target voice segments in the plurality of audio segments after a $K^{th}$ target voice segment, the non-target voice segment corresponding to speech output from an electronic device, and wherein the starting moment of the non-target voice segment is used as the ending moment of the at least one target voice segment.

* * * * *